US008181807B2

(12) United States Patent
Hay et al.

(10) Patent No.: US 8,181,807 B2
(45) Date of Patent: May 22, 2012

(54) CONTAINER ASSEMBLY

(75) Inventors: Henry Hay, Calgary (CA); Donald Belcher, Denham Springs, LA (US); Brian Ramsey, Bridgeville, PA (US)

(73) Assignee: NOVA Chemicals (International) S.A., Fribourg (CH)

( * ) Notice: Subject to any disclaimer, the term of this patent is extended or adjusted under 35 U.S.C. 154(b) by 293 days.

(21) Appl. No.: 12/698,319

(22) Filed: Feb. 2, 2010

(65) Prior Publication Data

US 2010/0219096 A1 Sep. 2, 2010

Related U.S. Application Data

(60) Provisional application No. 61/155,939, filed on Feb. 27, 2009.

(51) Int. Cl.
*B65D 6/00* (2006.01)

(52) U.S. Cl. ..... 220/8; 220/908; 220/826; 220/23.86; 220/23.4

(58) Field of Classification Search ..... 206/216, 206/503, 504, 505, 507, 509, 511, 514; 220/23.4, 220/23.6, 23.86, 23.87, 23.91, 4.27, 4.28, 220/623, 8, 908, 666, 230, 630, 23.89, 503, 220/504, 505

See application file for complete search history.

(56) References Cited

U.S. PATENT DOCUMENTS

| | | | | |
|---|---|---|---|---|
| 926,288 | A | 6/1909 | Rice | |
| 4,313,612 | A | 2/1982 | Rubens | |
| 4,335,828 | A * | 6/1982 | Robinson et al. | 220/826 |
| 4,550,849 | A * | 11/1985 | Adsit | 220/645 |
| 4,624,468 | A | 11/1986 | Onken | |
| 4,930,653 | A | 6/1990 | Machado | |
| D327,756 | S | 7/1992 | Klein et al. | |
| 5,183,180 | A * | 2/1993 | Hawkins et al. | 294/68.1 |

(Continued)

OTHER PUBLICATIONS

SteeLite Container Brochure, Otto Environmental Systems North America Inc., Publication Date: Apr. 16, 2007.

*Primary Examiner* — Anthony Stashick
*Assistant Examiner* — Chetan Chandra
(74) *Attorney, Agent, or Firm* — Gary F. Matz

(57) ABSTRACT

The present invention relates to a container assembly (1) that includes a support structure (11) and a container (14) that resides reversibly within the support structure interior (62). The support structure (11) includes a pair of opposed first and second support sidewalls (26, 29) each having an elongated tube (32, 44) having a first open end (38, 50) and an elongated hollow interior (35, 47). The container (14) has opposing sidewalls (77, 80) that each have an elongated channel (104, 110). The first and second elongated tubes (32, 44) of the support structure (11) are each reversibly received within the first and second elongated sidewall channels (104, 110) of the container (14), as the container is reversibly introduced (e.g., slid) into the support structure interior (62) through the open forward portion (65) of the support structure (11). The container assembly (1) may be reversibly lifted by lift members (e.g., lift forks 119, 122) introduced through the first open ends (38, 50) and into the elongated hollow interiors (35, 47) of the first and second elongated tubes (32, 44) of the support structure (11). At least a portion of the container (e.g., upper container portion 125') may have a three dimensional shape corresponding to an activity being conducted in the venue in which the container assembly is used, such as, a protective sports helmet shape (e.g., a hockey helmet shape) or a sports ball shape (e.g., a soccer ball shape).

20 Claims, 22 Drawing Sheets

U.S. PATENT DOCUMENTS 5,271,515 A * 12/1993 Berkheimer et al. ..... 220/4.27
5,330,071 A * 7/1994 Parker ..... 220/645
5,375,860 A 12/1994 Ernsberger et al.
5,445,397 A * 8/1995 Evans ..... 280/47.18
5,469,961 A * 11/1995 Chang ..... 206/312
5,562,229 A 10/1996 Callahan
5,704,625 A 1/1998 Presnell et al.
6,502,838 B1 1/2003 Kresse et al.
6,505,751 B1 1/2003 Haas
6,544,634 B1 4/2003 Abrams et al.
6,722,672 B2 4/2004 Cates et al.
6,736,415 B1 5/2004 Lenihan
D517,265 S * 3/2006 Berres et al. ..... D34/3
7,143,905 B2 12/2006 Enayati et al.
D547,516 S 7/2007 Wolford et al.
7,237,689 B2 * 7/2007 Maggio et al. ..... 220/675
7,762,565 B2 * 7/2010 Hatamian et al. ..... 280/79.5
2003/0127367 A1 7/2003 Neville
2005/0263970 A1 12/2005 Foster-Hentz

* cited by examiner

1

CONTAINER ASSEMBLY

CROSS REFERENCE TO RELATED PATENT APPLICATION

The present non-provisional patent application is entitled to and claims, under 35 U.S.C. §119(e), the benefit of U.S. Provisional Patent Application No. 61/155,939, filed Feb. 27, 2009, which is hereby incorporated herein in its entirety by reference.

FIELD OF THE INVENTION

The present invention relates to a container assembly that includes a support structure having opposing sidewalls that each include an elongated tube having an elongated hollow interior, and a container that is interchangeable with the support structure. The container has opposing sidewalls that each include an elongated sidewall channel. The elongated tubes of the support structure are reversibly received and reside within the elongated sidewall channels of the container. The container assembly may be lifted by means of lift members, such as, lift forks and/or lift straps, received within the elongated hollow interiors of the elongated tubes.

BACKGROUND OF THE INVENTION

Containers, such as, refuse containers, are typically substantially unitary structures. The sidewalls of refuse containers often include forklift pockets. The forklift pockets may be integral with or separately attached to the container sidewalls, and provide a means by which the container may be lifted and moved.

The appearance of a unitary container generally is not easily altered after it is fabricated and put into use. More particularly, the shape of a unitary container is not easily modified after fabrication. While, for example, different displays may be laminated or attached to a unitary container, the shape of the container, which is typically box-like or cylindrical in the case of a refuse container, can not be easily altered, if at all.

In certain venues, it is desirable to use refuse containers having a particular aesthetic look and shape that relates to or reflects a particular event that is being held in the venue. In the case of a multi-use sports venue, for example, it would be desirable to use refuse containers having a particular sports ball or sports helmet shape that corresponds with the sports event being held within the venue. For example, soccer ball shaped refuse containers for soccer games, or rugby ball shaped refuse containers for rugby games, or football helmet shaped refuse containers for American football games, etc. In the case of a convention center, it might be advantageous to have RV-shaped refuse containers for a recreational vehicle (RV) show, or boat shaped refuse containers for a boat show, etc.

With unitary refuse containers, the whole container typically must be replaced if a refuse container having a different shape is desired. In addition, space must also be provided to store the alternatively shaped refuse containers that are not in use.

It would be desirable to develop new containers, such as, refuse containers, that may be easily and efficiently interchanged so as to provide different shaped containers, that relate to or reflect different events held within a venue. In addition, it would be desirable that such newly developed containers require less storage space when not in use, relative to present containers, such as unitary containers. It would be further desirable that such newly developed containers have physical properties (e.g., impact and rupture resistance, and volume and weight capacity) that are equivalent to or better than those of present containers, such as, unitary containers.

SUMMARY OF THE INVENTION

In accordance with the present invention, there is provided a container assembly comprising:

(a) a support structure comprising, (i) a support base having an upper surface, (ii) a first support sidewall extending upwardly from said support base, said first support sidewall comprising a first elongated tube having an elongated hollow interior and a first open end that is in communication with said elongated hollow interior of said first elongated tube, and (iii) a second support sidewall extending upwardly from said support base, said second support sidewall comprising a second elongated tube having an elongated hollow interior and a first open end that is in communication with said elongated hollow interior of said second elongated tube, said first support sidewall and said second support sidewall being laterally spaced apart and opposed from each other, said support base, said first support sidewall and said second support sidewall together defining a support structure interior and an open forward portion of said support structure; and (b) a container having a container base, a first container sidewall, a second container sidewall, a front container wall and a rear container wall each extending upwardly from said container base and together defining an open container top and a container interior, said container base having a lower surface, said first container sidewall and said second container sidewall being laterally spaced apart and opposed from each other and each having an exterior surface, said exterior surface of said first container sidewall having a first elongated channel, said first elongated channel having a first open end along said rear container wall, said first open end of said first elongated channel and said first elongated channel each being dimensioned to receive reversibly at least a portion of said first elongated tube, said exterior surface of said second container sidewall having a second elongated channel, said second elongated channel having a first open end along said rear container wall, said first open end of said second elongated channel and said second elongated channel each being dimensioned to receive reversibly at least a portion of said second elongated tube, wherein at least a portion (e.g., a lower portion) of said container resides reversibly within said support structure interior, at least a portion of said first elongated tube resides reversibly within said first elongated channel, and at least a portion of said second elongated tube resides reversibly within said second elongated channel, further wherein said first open end and said elongated hollow interior of said first elongated tube are each dimensioned to receive a first lift member therein, and said first open end and said elongated hollow interior of said second elongated tube are each dimensioned to receive a second lift member therein, thereby allowing said container assembly to be reversibly lifted.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings in which preferred embodiments of the invention are illustrated and described.

As used herein and in the claims, terms of orientation and position, such as "upper", "lower", "inner", "outer", "right", "left", "vertical", "horizontal", "top", "bottom", and similar terms, are used to describe the invention as oriented in the drawings. Unless otherwise indicated, the use of such terms is not intended to represent a limitation upon the scope of the invention, in that the invention may adopt alternative positions and orientations.

Unless otherwise indicated, all numbers or expressions, such as those expressing structural dimensions, quantities of ingredients, etc. used in the specification and claims are understood as modified in all instances by the term "about".

BRIEF DESCRIPTION OF THE DRAWINGS

FIGS. 12*a* and 12*b* are sectional representations of a pair of aligned first tube-first channel apertures, without and with the first retaining pin received there-through;

FIGS. 13*a* and 13*b* are sectional representation of a pair of aligned second tube-second channel apertures, without and with the second retaining pin received there-through;

In FIGS. 1 through 22, like reference numerals designate the same components and structural features, unless otherwise indicated.

DETAILED DESCRIPTION OF THE INVENTION

Figure 1:
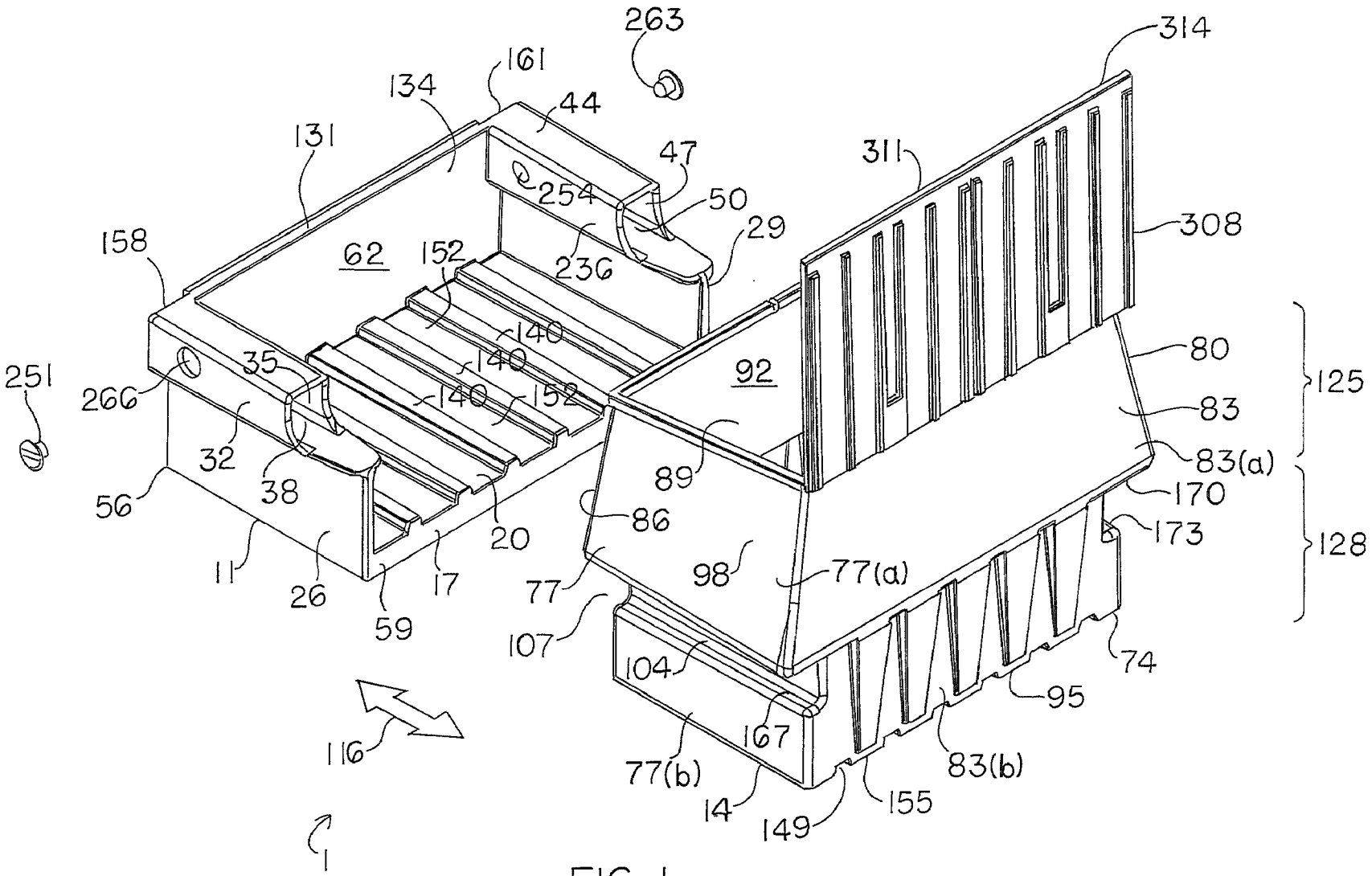
FIG. 1 is a representative perspective exploded view of a container assembly according to the present invention.

With reference to FIGS. 1 through 11 of the drawings there is depicted an embodiment of a container assembly 1, according to the present invention, that includes a support structure 11 and a container 14, that is reversibly received within the support structure interior 62. Support structure 11 includes: a support base 17 having an upper surface 20 and a lower surface 23; a first support sidewall 26; and a second support sidewall 29.

First support sidewall 26 extends upwardly from support base 17 of support structure 11. First support sidewall 26 includes a first elongated tube 32 that has an elongated hollow interior 35 and a first open end 38 that is in communication with elongated hollow interior 35. First elongated tube 32 may be located at any point along first support sidewall 26. For example, first elongated tube 32 may be positioned at an intermediate point along or within first support sidewall 26, in which case, first support sidewall 26 extends further upwardly above first elongated tube 32 (not depicted in the drawings). More typically, first elongated tube 32 is positioned at or on an upper terminus 41 (FIG. 11) of first support sidewall 26.

Second support sidewall 29 also extends upwardly from support base 17 of support structure 11. Second support sidewall 29 includes a second elongated tube 44 that has an elongated hollow interior 47 and a first open end 50 that is in communication with elongated hollow interior 47. As with and independently of first elongated tube 32 relative to first sidewall 26, second elongated tube 44 may be located at any point along second support sidewall 29. For example, second elongated tube 44 may be positioned at an intermediate point along or within second support sidewall 29, in which case, second support sidewall 29 extends further upwardly above second elongated tube 44 (not depicted in the drawings). More typically, second elongated tube 44 is positioned at or on an upper terminus 53 (FIG. 11) of second support sidewall 29.

First support sidewall 26 and second support sidewall 29 are laterally spaced apart and are opposed from each other. The support base of the support structure may extend laterally outward beyond the first and/or second sidewalls, e.g., forming an outboard lower lip or shelf on one or both sides of the support structure (not depicted in the drawings). In a particular embodiment, and as depicted in the drawings, the first and second support sidewalls (26, 29) are positioned at and substantially define opposite sides (e.g., terminal sides) of the support structure (e.g., 11).

Support structure 11 has a rear portion 56 and a forward portion 59. The first and second support sidewalls (26, 29) typically extend from rear portion 56 to forward portion 59 of support structure 11. The first and second support sidewalls (26, 29) may, relative to each other, be substantially parallel, or non-parallel (e.g., outwardly and/or inwardly angled from the rear to forward portions of the support structure). The first and second elongated tubes (32, 44) extend at least a partial distance (e.g., substantially the whole distance) between the rear and forward portions (56, 59) of the support structure. The first and second elongated tubes may each independently extend: substantially, the whole distance from the rear to the forward portions of the support structure; less than the whole distance from the rear to the forward portions of the support structure; or less than the whole distance from the forward portion to the rear portion of the support structure. As depicted in the drawings with regard to container assembly 1, the first and second elongated tubes (32, 44) each extend less than the whole distance from the rear portion 56 to the forward portion 59 of support structure 11 (e.g., about ⅔ of the whole/total distance from the rear portion 56 to the forward portion 59 of support structure 11).

The first open ends of the first and second elongated tubes may each independently be located on or towards: the rear portion (e.g., 56) or forward portion (e.g., 59) of the support structure; or the rear tube portion (e.g., 176, 188, FIGS. 9 and 10) or the front tub portion (e.g., 179, 191, FIGS. 9 and 10) of each elongated tube. Typically, the first open ends of the first and second elongated tubes are both located on or towards: either the rear portion or the forward portion of the support structure; or either the rear tube portion of the front tube portion of each elongated tube. More typically, and as depicted in the drawings, first open end 38 of first elongated tube 32, and first open end 50 of second elongated tube 44 are both located or positioned towards the forward portion 59 of support structure 11 (and the front tube portion, e.g., 179, 191, of each elongated tube).

Support base 17, first support sidewall 26 and second support sidewall 29 together define a support structure interior 62 and an open forward portion 65 of support structure 11. More particularly, the interior surfaces of support base, and first and second sidewalls define the support structure interior. For example, upper surface 20 of support base 17, interior surface 68 of first support sidewall 26 and interior surface 71 of second support sidewall 29 together define support structure interior 62. See, for example, FIG. 11.

Figure 9:
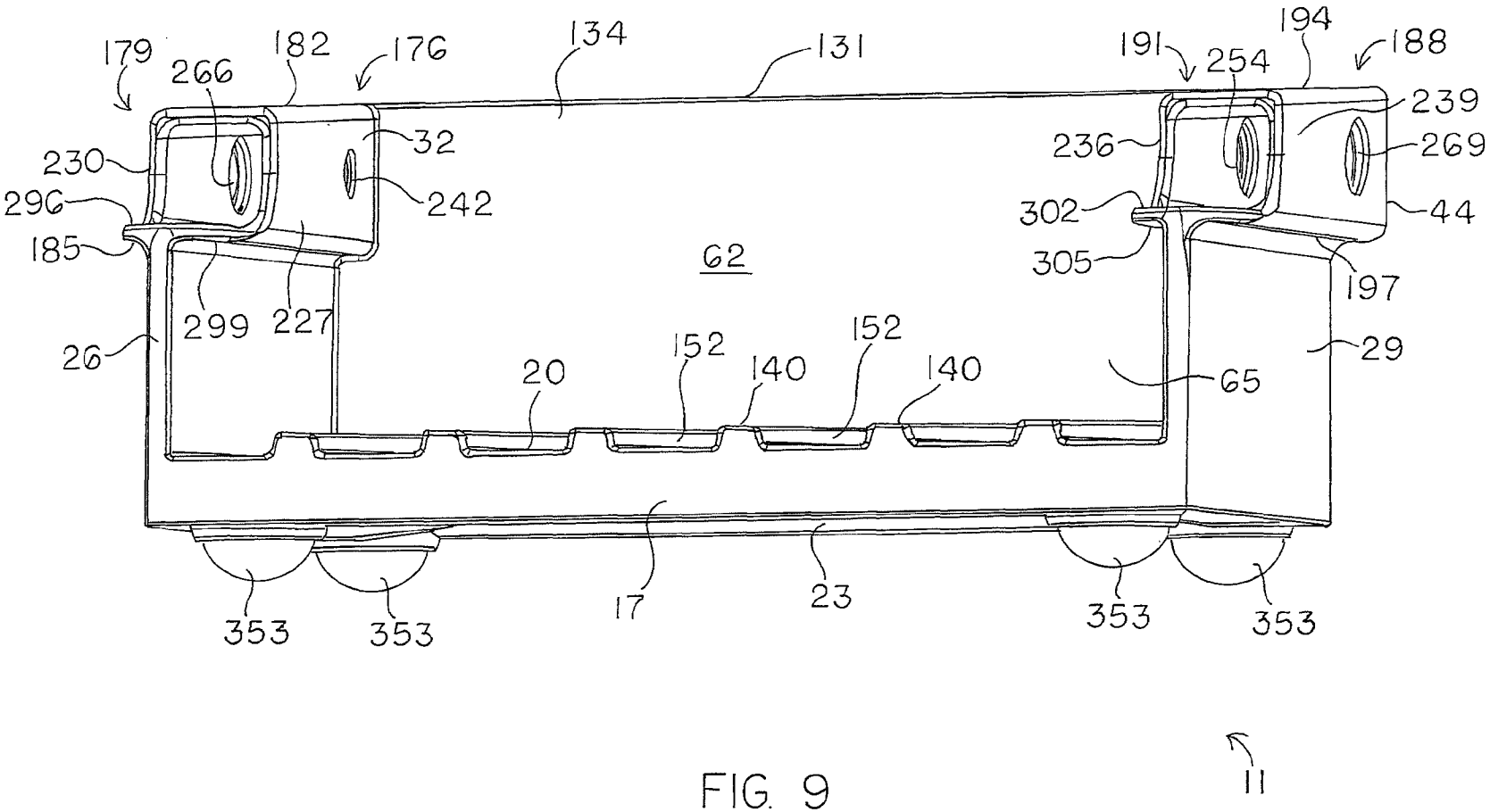
FIG. 9 is a representative perspective view towards the open forward portion of the support structure of FIG. 8, showing the elongated hollow interiors of the first and second elongated tubes thereof, and aligned apertures of the outboard and inboard tube wall portions.
Figure 10:
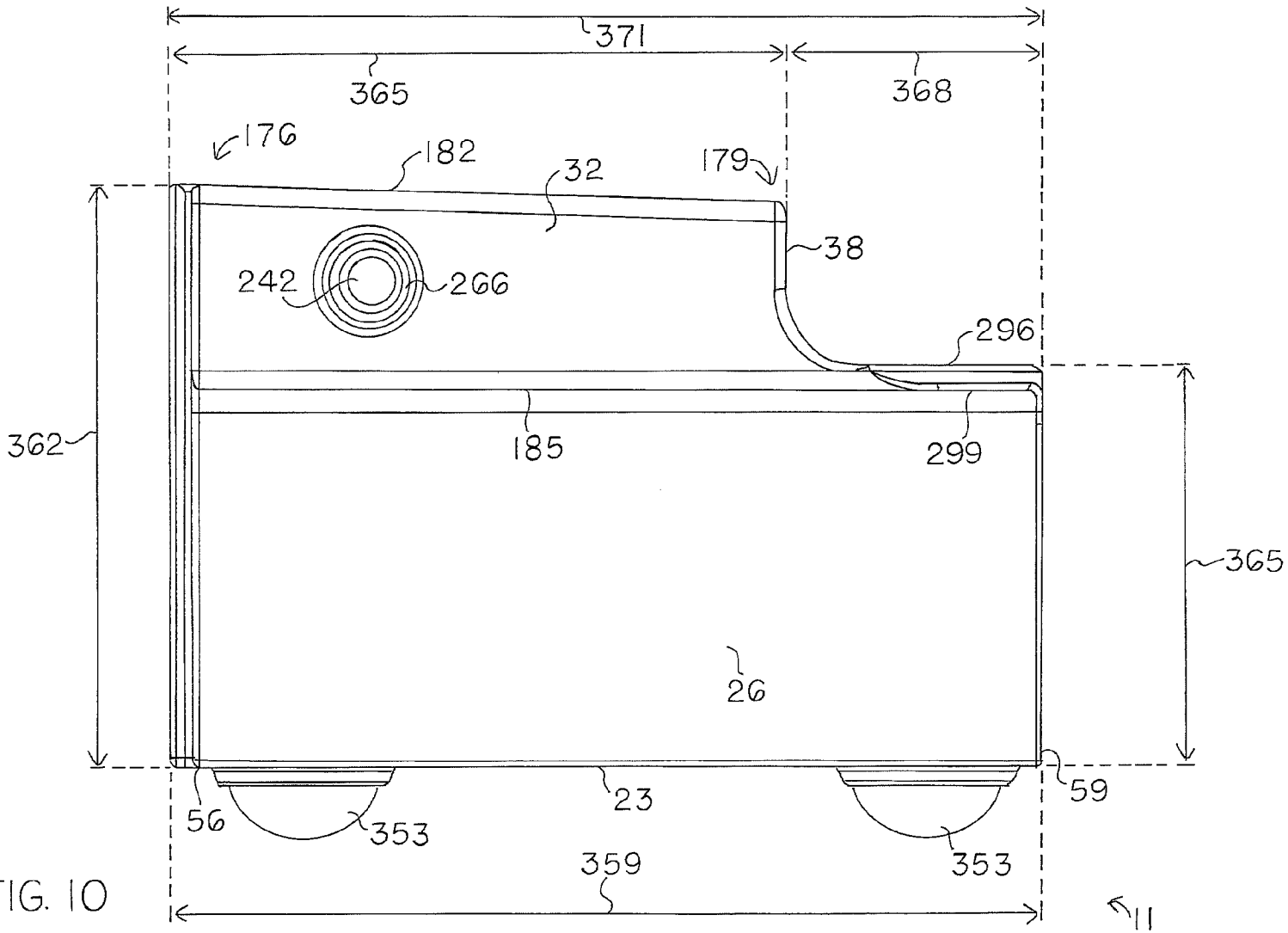
FIG. 10 is a representative elevational view of the first support sidewall of the support structure of FIG. 8.
Figure 11:
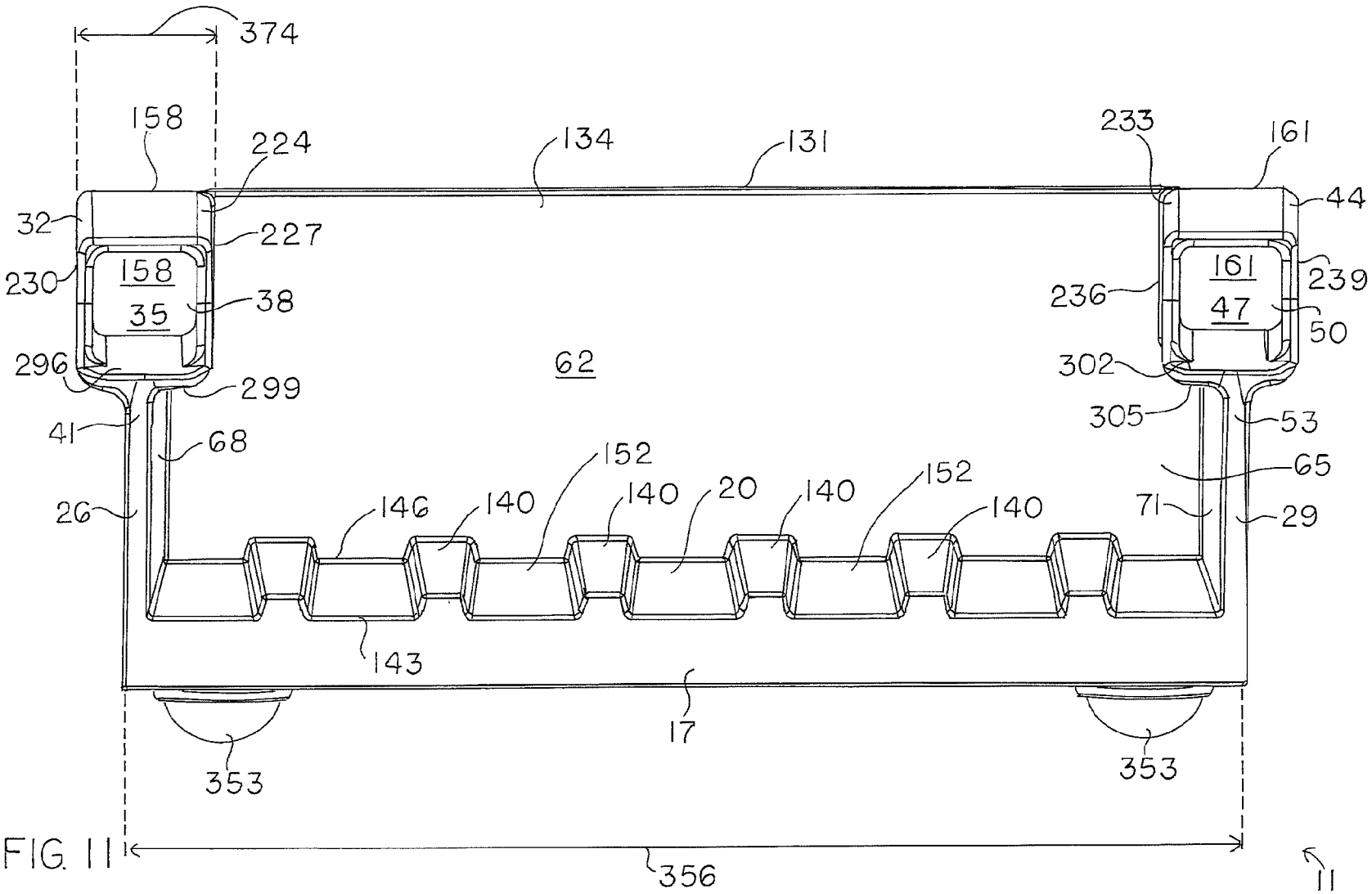
FIG. 11 is a representative shallow perspective view towards the open forward portion of the support structure of FIG. 8, showing the elongated hollow interiors and the first and second open ends of the first and second elongated tubes thereof.

The lower surface of the support base of the support structure may, optionally, further include a plurality of lower supports (typically, 2 or more) that serve to position (or raise) the lower surface of the support base above the surface on which the support structure is placed (e.g., ground or a floor). With reference to FIGS. 9 through 11, lower surface 23, of support base 17 of support structure 11, includes a plurality of (and, in particular, 4) lower supports or feet 353 that extend downward from lower surface 23. Each lower support 353 may have any suitable shape (e.g., polygonal or spherical shapes). As depicted in the drawing figures, each lower support 353 has a substantially semi-spherical shape. Each lower support may be further adapted to include wheels or casters (not shown) upon which the support structure, and, correspondingly, the container assembly may be rolled (or moved).

Container 14 of container assembly 1 includes a container base 74, a first container sidewall 77, a second container sidewall 80, a front container wall 83, and a rear container wall 86. The first container sidewall 77, second container sidewall 80, front container wall 83 and rear container wall 86 each extend upwardly from container base 74, and together define an open container top 89, and a container interior space 92. Container base 74 has a lower surface 95. The first container sidewall, second container sidewall, front container wall and rear container wall, or any portion thereof (e.g., one or more upper portions), may each independently have any suitable shape or configuration (e.g., having substantially flat panel shapes including flat exterior surfaces, or 3-dimensional shapes).

The first container sidewall 77 is typically adjoined to both of the rear container wall 86 and the front container wall 83; and the second container sidewall 80 is, typically, adjoined to both of the rear container wall 86 and the front container wall 83. Correspondingly, the rear container wall 86 is typically adjoined to both of the first container sidewall 77 and the second container sidewall 80; and the front container wall 83 is, typically, adjoined to both of the first container sidewall 77 and the second container sidewall 80. The container may, optionally, include one or more further exterior walls interposed between and further connecting any of the adjoined pairs of the above described first container sidewall, second container sidewall, front container wall and rear container wall.

First container sidewall 77 and second container sidewall 80 are laterally spaced apart and opposed to each other, and each has an (i.e., its own separate) exterior surface. More particularly, first container sidewall 77 has an exterior surface 98, and second container sidewall 80 has an exterior surface 101.

The exterior surface 98 of first container sidewall 77 has or defines a first elongated channel 104. First elongated channel 104, of first container sidewall 77, has a first open end 107 that is positioned along (e.g., substantially aligned with) rear container wall 86 of container 14. First elongated channel 104 and the first open end 107 thereof, are each dimensioned so as to receive reversibly at least a portion of first elongated tube 32 there-through (more particularly with regard to first open end 107) and therein (more particularly with regard to first elongated channel 104).

The exterior surface 101 of second container sidewall 80 has, or defines, a second elongated channel 110. Second elongated channel 110, of second container sidewall 80, has a first open end 113 that is positioned along (e.g., substantially aligned with) rear container wall 86 of container 14. See, for example, FIGS. 3 and 5. Second elongated channel 110 and the first open end 113 thereof, are each dimensioned so as to receive reversibly at least a portion of second elongated tube 44 there-through (more particularly with regard to first open end 113) and therein (more particularly with regard to second elongated channel 110).

With container assembly 1 assembled, container 14, and, more typically, a portion (e.g., a lower portion) of container 14, resides reversibly within support structure interior 62 of support structure 11. In addition, at least a portion of first elongated tube 32 resides reversibly within first elongated channel 104 of first container sidewall 77, and at least a portion of second elongated tube 44 resides reversibly within second elongated channel 110 of second container sidewall 80. Typically, support structure 11 and container 14 are brought (or slid) together (e.g., as indicated by double-headed arrow 116 of FIG. 1) with rear container wall 86 passing through open forward portion 65 of support structure 11, such that at least a portion of container 14 comes to reside within support structure interior 62.

As support structure 11 and container 14 are slid together, at least a portion of first elongated tube 32 passes through the first open end 107 of, and comes to reside within, first elongated channel 104 of first container sidewall 77 of container 14. Correspondingly, and typically substantially concurrently, at least a portion of second elongated tube 44 passes through first open end 113 of, and comes to reside within, second elongated channel 110 of second container sidewall 80 of container 14. During the process of moving container 14 into or out of support structure interior 62, typically, support structure 11 is substantially stationary, and container 14 is in motion. The support structure and container may be brought (e.g., slid) together or separated by mechanical (e.g., one or more hoists or lifts, not shown) and/or manual means (e.g., one or more persons, not shown).

Figure 2:
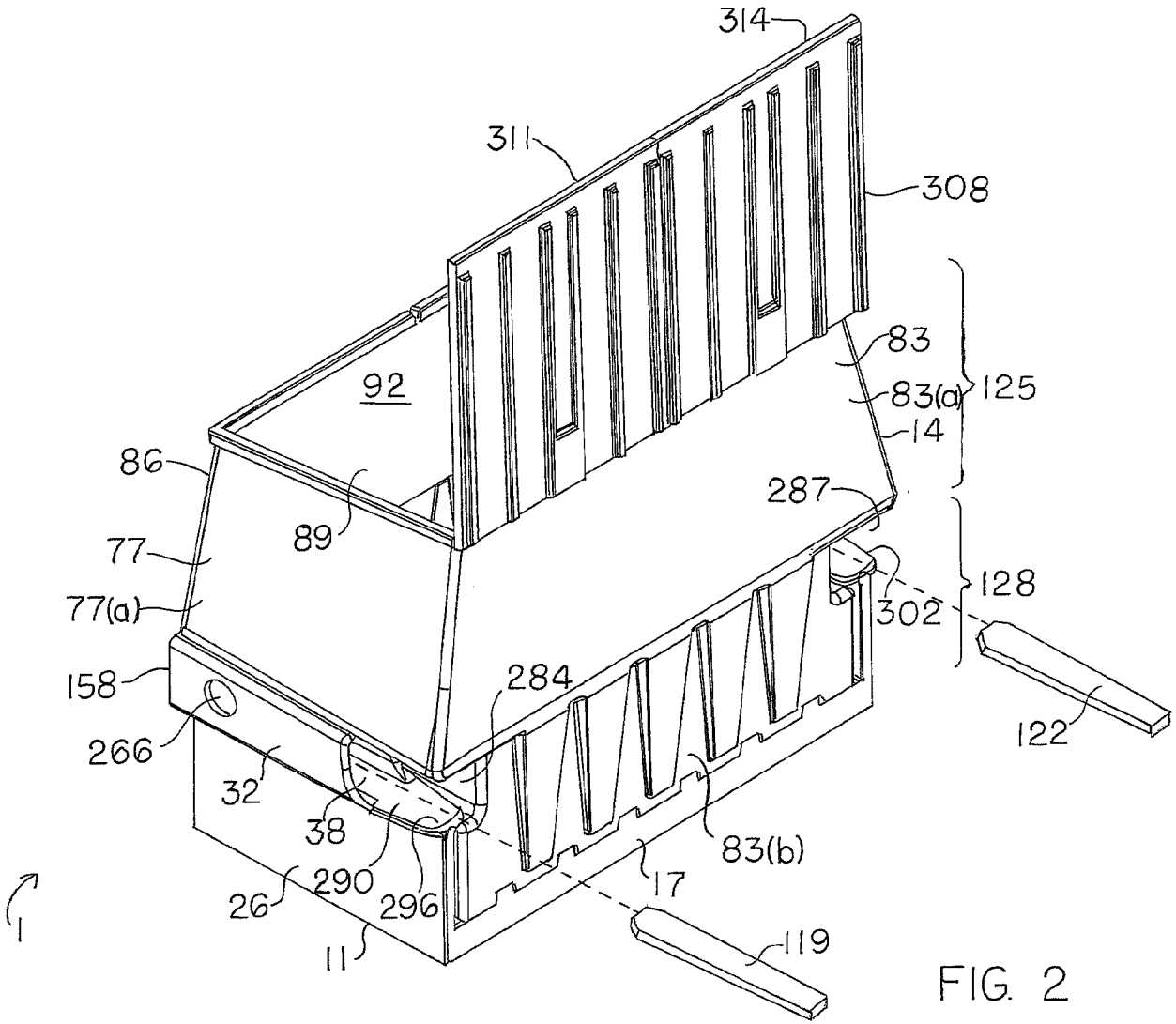
FIG. 2 is a representative perspective non-exploded view of the container assembly of FIG. 1, towards the first container sidewall side of the container.

First open end 38 and elongated hollow interior 35 of first elongated tube 32 are each dimensioned to receive a first lift member 119 therein. First open end 50 and elongated hollow interior 47 of second elongated tube 44 are each dimensioned to receive a second lift member 122 therein. See, for example, FIG. 2. With the first open ends and elongated hollow interiors of the first and second elongated tubes dimensioned so as to receive separate lift members therein, the container assembly of the present invention may be reversibly lifted. The lift members may each be independently selected from art-recognized lift members, such as, lift forks and/or lift straps (not shown). As depicted in FIG. 2, the first and second lift members are in the form of lift forks, that each may be attached to the same lift device (e.g., a single fork lift), or separate lift devices (e.g., two separate fork lifts). While the first and second lift members (119, 122) are depicted in FIG. 2 as being introduced through the first open ends (38, 50) of the first and second elongated tubes (32, 44), at least one and, typically, both thereof may alternatively be inserted through the second open ends (158, 161) of the first and second elongated tubes (32, 44).

In an embodiment, the container includes an upper container portion and a lower container portion. The lower container portion resides substantially below the upper container portion, and is inclusive of the first elongated channel and the second elongated channel. The lower container portion resides substantially within the support structure interior. The upper container portion resides substantially above the first elongated channel, the second elongated channel, and above the lower container portion. In addition, the upper container portion resides above (e.g., extends up out of) the support structure interior.

The first and second support sidewalls, and the front and rear container walls may each independently have: an upper portion that in each case resides substantially above the first and/or second elongated channels; and a lower portion that in each case resides substantially below the upper portion of the associated sidewall or wall thereof. The lower portions of the first and second support sidewalls are in each case, typically, inclusive of the respective first and second elongated channels.

The container may accordingly have: an upper container portion that is defined by one or more of the upper portions of the first and second support sidewalls, and the upper portions of the front and rear container walls; and a lower container portion that is defined by one or more of the lower portions of the first and second support sidewalls, and the lower portions of the front and rear container walls. The upper container portion, typically, resides substantially above the first and second elongated channels of the first and second container sidewalls, and the lower container portion, typically, resides substantially below the upper container portion and is inclusive of the first and second elongated channels of the first and second container sidewalls. The upper portions of the first and second support sidewalls, and the upper portions of the front and rear container walls, and, correspondingly, the upper portion of the container, typically, reside substantially above (e.g., extend upwardly out of): the support structure interior; and the first and second elongated tubes of the support structure. The lower portions of the first and second support sidewalls, and the lower portions of the front and rear container walls, and, correspondingly, the lower portion of the container, typically, reside substantially within the support structure interior.

The exterior of the upper portion and the lower portion of the container may each have substantially the same shape, or different shapes, relative to each other. In addition, the interior of the upper portion and the interior of the lower portion of the container may each have substantially the same shape, or different shapes, relative to each other. For example, the exterior of the upper portion of the container and the exterior of the lower portion of the container may each independently have sectional shapes selected from irregular shapes, oval shapes, polygonal shapes (e.g., rectangular, pentagonal, hexagonal, heptagonal, octagonal, nonagonal, decagonal, etc. shapes) and combinations thereof. The interior of the upper portion of the container and the interior of the lower portion of the container may each independently have sectional shapes selected from irregular shapes, circular shapes, oval shapes, polygonal shapes (e.g., rectangular, pentagonal, hexagonal, heptagonal, octagonal, nonagonal, decagonal, etc. shapes) and combinations thereof. Typically, the exterior of the lower portion of the container has a sectional shape selected from polygonal shapes, such as, substantially rectangular shapes.

Figure 3:
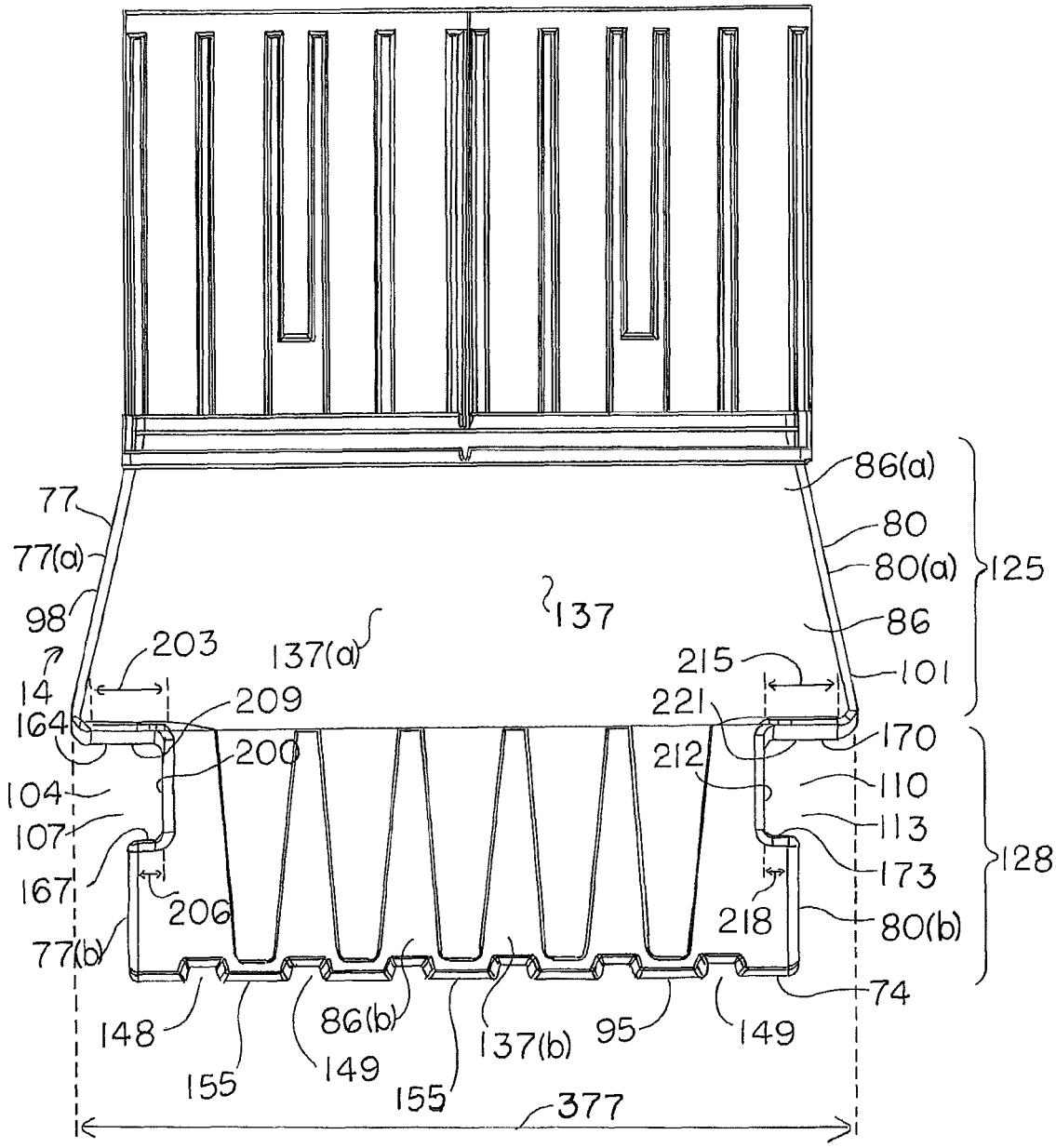
FIG. 3 is a representative elevational view towards the rear container wall of the container alone of the container assembly of FIG. 1.

With reference to FIGS. 1 through 3, first container sidewall 77 may have a first container sidewall upper portion 77(*a*), and a first container sidewall lower portion 77(*b*). Second container sidewall 80 may have a second container sidewall upper portion 80(*a*) and a second container sidewall lower portion 80(*b*). Front container wall 83 may have a front container wall upper portion 83(*a*) and a front container wall lower portion 83(*b*). Rear container wall 86 may have a rear container wall upper portion 86(*a*) and a rear container wall lower portion 86(*b*).

With further reference to FIGS. 1 through 3, first container sidewall upper portion 77(*a*), second container sidewall upper portion 80(*a*), front container wall upper portion 83(*a*) and rear container wall upper portion 86(*a*) together define an upper container portion 125. First container sidewall lower portion 77(*b*), second container sidewall lower portion 80(*b*), front container wall lower portion 83(*b*) and rear container wall lower portion 86(*b*) together define a lower container portion 128. Upper container portion 125 resides substantially above first elongated channel 104 and second elongated channel 110. Lower container portion 128 resides substantially below upper container portion 125, and includes first elongated channel 104 and second elongated channel 110. With reference to FIG. 2, upper container portion 125 of container 14 resides substantially above (or extends up out of) support structure interior 62, while lower container portion 128 resides substantially within support structure interior 62 of support structure 11.

In addition to having an open forward portion (e.g., 65), the support structure may optionally also have an open rear portion (not depicted in the drawings). The open forward portion and open rear portion of the support structure are typically substantially opposed from each other. When the support structure has an open rear portion, the container (e.g., 14) may be introduced (e.g., slidingly introduced) into the support structure interior (e.g., 62) by either: passing the rear container wall (e.g., 86) through the open front portion (e.g., 65) of the support structure; or passing the front container wall (e.g., 83) through the open rear portion of the support structure.

In an embodiment of the present invention, the support structure further includes a rear support wall. With reference to, for example, FIGS. 1, 8, 9 and 11, support structure 11 further includes a rear support wall 131 having an interior surface 134. Rear support wall 131 is positioned along rear portion 56 of support structure 11. Rear support wall 131 extends between and is typically connected to (e.g., continuous with) first support wall 26 and second support wall 29. In addition, rear support wall 131 may be connected to (e.g., continuous with) a portion of first elongated tube 32 and second elongated tube 44, and, in particular, rear portions of each tube.

With the support structure further including a rear support wall, the support structure interior is, typically, defined by a combination of the first support sidewall, the second support sidewall, and the rear support wall, and, in particular, by the interior surfaces thereof. With reference to 11, first support sidewall 26, second support sidewall 29, and rear support wall 131 together define support structure interior 62. In particular, and with further reference to FIG. 11, interior surface 68 of first support sidewall 26, interior surface 71 of second support sidewall 29, and interior surface 134 of rear support wall 131 together define support structure interior 62.

The container is typically positioned within the support structure interior, such that there is abutment between: (i) at least a portion of the interior surface of the rear support wall; and (ii) at least a portion (e.g., a lower portion) of the exterior surface of the rear container wall. With reference to FIG. 3, rear support wall 86 has an exterior surface 137. In particular, rear support wall 86 has an upper exterior surface portion 137(*a*) and a lower exterior surface portion 137(*b*). More particularly, rear container wall upper portion 86(*a*) has an upper exterior surface portion 137(*a*), and rear container wall lower portion 86(*b*) has a lower exterior surface portion 137 (*b*).

When container 14 is received within support structure interior 62, as depicted, for example, in FIG. 2, at least a portion of interior surface 134 of rear support wall 131, and a portion of exterior surface 137 of rear container wall 86, abut each other. In particular, at least a portion of interior surface 134 of rear support wall 131, and at least a portion of lower exterior surface portion 137(*b*) of exterior surface 137 of rear container wall 86 (and, in particular, rear container wall lower portion 86(*b*)), are in abutment with each other.

At least a portion of the upper surface of the support base of the support structure, and at least a portion of the lower surface of the container base may have a spatial relationship there-between that is selected from opposingly separated and/or abutting. For example, at least a portion of upper surface 20 of support base 17 of support structure 11, and at least a portion of lower surface 95 of container base 74 of container 14, may have an opposingly separated spatial relationship there-between (not depicted in the drawings). Having an opposingly separated spatial relationship between at least a portion of upper surface 20 of support base 17, and at least a portion of lower surface 95 of container base 74, may be desirable for purposes of allowing liquids seeping out of container 14 (e.g., through perforations in container base 74, not shown) to be removed from the container assembly without having to disassemble the container assembly. Such seeping liquids may result from liquid containing refuse containers (e.g., soft drink containers) being introduced into the container interior. More typically, and as depicted, for example, in FIG. 2, upper surface 20 of support base 17 of support structure 11, and lower surface 95 of container base 74 of container 14, have a substantially abutting spatial relationship there-between.

In an embodiment, and for purposes including, but not limited to, optimized alignment, positioning and receipt of the container within the support structure interior, the upper surface of the support base and the lower surface of the container base have an interrelated or cooperating tongue and groove arrangement there-between. In particular, the upper surface of the support base may include a plurality of elongated tongues extending upwardly from the upper surface of the support base. The elongated tongues extend from a rear portion to a forward portion of the support base. The lower surface of the container base may correspondingly include a plurality of elongated grooves that extend from the rear container wall to the front container wall. The elongated grooves of the lower surface of the container base are dimensioned so as to reversibly receive the elongated tongues of the upper surface of the support base therein. With the container residing within the support structure interior, the elongated tongues of the upper surface of the support base reside reversibly within the elongated grooves of the lower surface of the container base.

With reference to FIGS. 2, 3, 7, 8 and 11, upper surface 20 of support base 17 of support structure 11 includes a plurality of elongated tongues 140 that extend upwardly from upper surface 20 of support base 17. Support base 17 has a forward portion 143 and a rear portion 146. Each elongated tongue 140 of the support base 17 extends substantially from rear portion 146 to forward portion 143 of support base 17 of support structure 11. The plurality of elongated tongues 140 of support base 17 are, typically, substantially parallel relative to each other. Lower surface 95 of container base 74 of container 14 includes a plurality of elongated grooves 149 that each extend substantially from rear container wall 86 to front container wall 83. At least one, and, typically, each elongated groove 149 of lower surface 95 of container base 74 is dimensioned to receive reversibly therein a single elongated tongue 140 of upper surface 20 of support base 17. Accordingly, with container 14 residing within support structure interior 62, at least one and, typically, each elongated tongue 140 of upper surface 20 of support base 17 of support structure 11, resides reversibly within a single elongated groove 149 of lower surface 95 of container base 74 of container 14.

Each pair of elongated tongues of the upper surface of the support base effectively defines there-between an elongated support base groove. As such, in addition to including a plurality of elongated tongues 140, the upper surface 20 of the support base 17 of the support structure 11 also includes a plurality of elongated support base grooves 152. Each pair of elongated grooves of the lower surface of the container base of the container has there-between an elongated container base tongue. Each pair of elongated container base tongues effectively defines an elongated groove (e.g., 149) of the container base there-between. Accordingly, in addition to including a plurality of elongated grooves 149, lower surface 95 of container base 74 of container 11 also includes a plurality of elongated container base tongues 155. At least one, and, typically, each elongated support base groove 152 is dimensioned to receive reversibly therein a single elongated container base tongue 155. With container 14 residing within support structure interior 62, in addition to: each elongated tongue 140 of the support base reversibly residing within a single elongated groove 149 of container base 74; each elongated container base tongue 155 resides reversibly within a single elongated support base groove 152.

In addition to having a first open end, the first elongated tube and/or the second elongated tube may each independently have a second open end that is in communication with the elongated hollow interior of the tube, and which is located at the opposite end of the tube relative to the first open end thereof. The second open end of an elongated tube may be used to lift the container assembly from a side that is opposite that of the first open end of the tube. Using a second open end of a tube to lift the container assembly may be desirable, for example, if the first open end of one or both tubes is obstructed (e.g., by a portion of the container, or a structure that is separate from the container assembly, such as, a wall).

In an embodiment, the first elongated tube has a second open end that is in communication with the elongated hollow interior of the first elongated tube. The first open end and the second open end of the first elongated tube are each located at opposite ends of the first elongated tube. Alternatively, or in addition thereto, the second elongated tube may have a second open end that is in communication with the elongated hollow interior of the second elongated tube, and the first open end and the second open end of the second elongated tube are each located at opposite ends of the second elongated tube.

Figure 8:
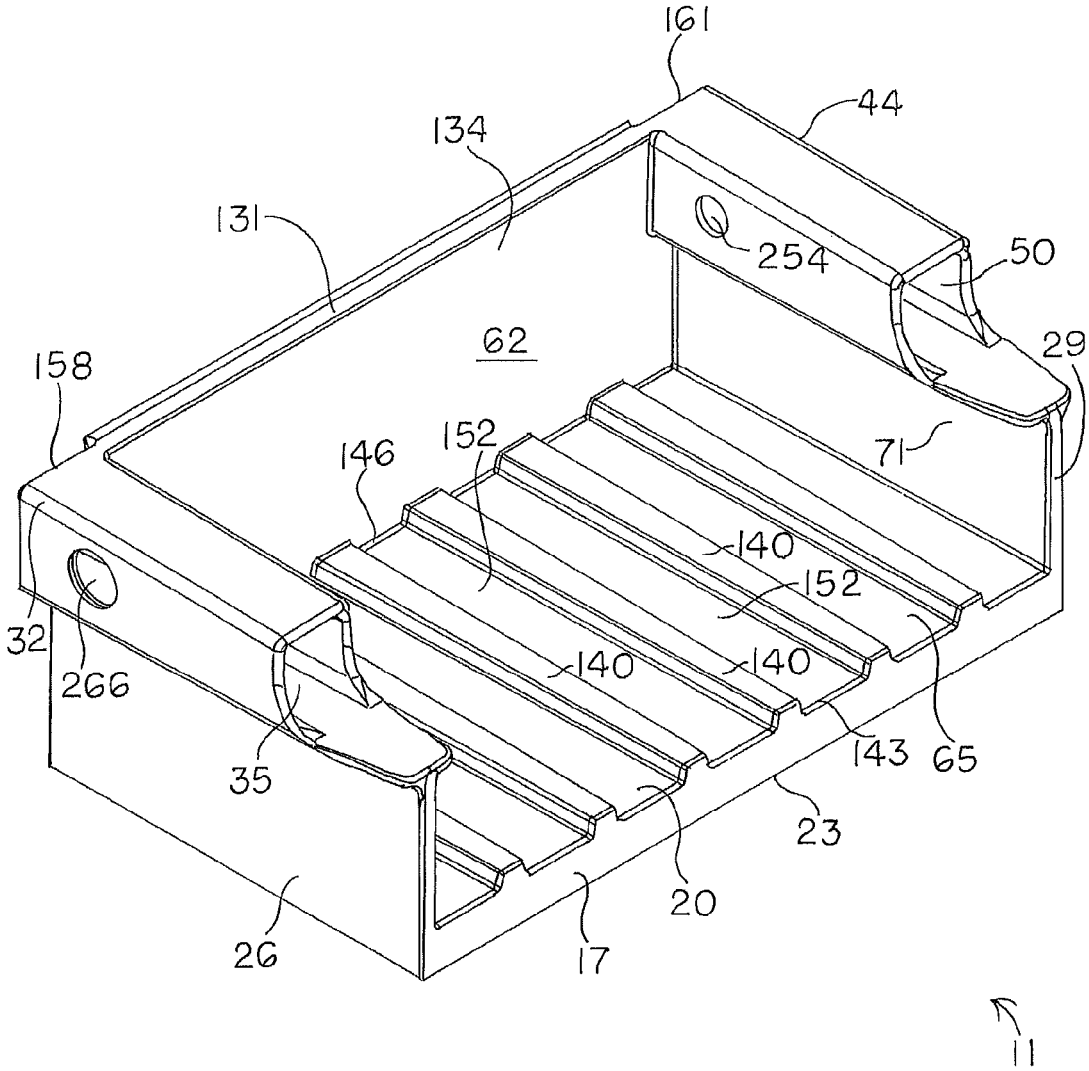
FIG. 8 is a representative perspective view of the support structure alone of the container assembly of FIG. 1.

With reference to FIGS. 8 and 11, first elongated tube 32 of support structure 11 has a second open end 158 that is in communication with elongated hollow interior 35 thereof. First open end 38 and second open end 158 are each located at opposite ends of first elongated tube 32. Second elongated tube 44 has a second open end 161 that is in communication with elongated hollow interior 47 thereof. First open end 50 and second open end 161 are each located at opposite ends of second elongated tube 44.

In an embodiment, the first and second channels of the first and second sidewalls of the container are each tapered, and the first and second elongated tubes of the support structure each have a taper that substantially matches the taper of the associated first and second channels. The tapered elongated tubes reside abuttingly and fittingly within the matching tapered channels. The tapered fit between the tapered elongated tubes and the tapered channels limits the extent (e.g., linear extent) to which the container may slide into the support structure interior. Limiting the extent to which the container may be slid into the support structure interior is desirable when the support structure is free of a rear support wall, and has an open rear portion. In the absence of fitted taper between the elongated tubes and the channels, the container may slide too far along the elongated tubes and out through the open rear portion of the support structure. In addition, the fitted taper between the elongated tubes and the channels may be desirable for purposes of aligning apertures in walls of the elongated tubes with apertures in the sidewalls of the container through which retaining pins may be received, thereby retaining the container within the support structure interior.

In an embodiment of the present invention, the first elongated channel and the second elongated channel are each independently defined in part by an upper channel surface and a lower channel surface. The upper channel surface and the lower channel surface of each of the first elongated channel and the second elongated channel in each case taper towards each other from the rear container wall towards the front container wall. The first elongated tube and the second elongated tube each have a rear tube portion, a front tube portion, an exterior upper tube surface and an exterior lower tube surface. The exterior upper tube surface and the exterior lower tube surface of each of the first elongated tube and the second elongated tube, in each case, taper towards each other from the rear tube portion towards the front tube portion.

With the first and second elongated tubes of the support structure, and the first and second elongated channels of the container sidewalls, so tapered, the front tube portion of the first elongated tube is received through the first open end of the first elongated channel. The exterior upper tube surface of the first elongated tube abuts the upper channel surface of the first elongated channel, and the exterior lower tube surface of the first elongated tube abuts the lower channel surface of the first elongated channel. Correspondingly, the front tube portion of the second elongated tube is received through the first open end of the second elongated channel. The exterior upper tube surface of the second elongated tube abuts the upper channel surface of the second elongated channel, and the exterior lower tube surface of the second elongated tube abuts the lower channel surface of the second elongated channel. The first elongated tube and the first elongated channel, and the second elongated tube and the second elongated channel, each accordingly have a tapered fit there-between.

With reference to the drawings, and, in particular, FIG. 3, first elongated channel 104, of first container sidewall 77 of container 14, has (i.e., is defined in part by) an upper channel surface 164 and a lower channel surface 167. Upper channel surface 164 and lower channel surface 167 of first elongated channel 104, taper towards each other from rear container wall 86 to front container wall 83. See, for example, FIG. 4. Second elongated channel 110, of second container sidewall 80 of container 14, has (i.e., is defined in part by) an upper channel surface 170 and a lower channel surface 173. Upper channel surface 170 and lower channel surface 173 of second elongated channel 110, taper towards each other from rear container wall 86 to front container wall 83. See, for example, FIG. 5.

Figure 19:
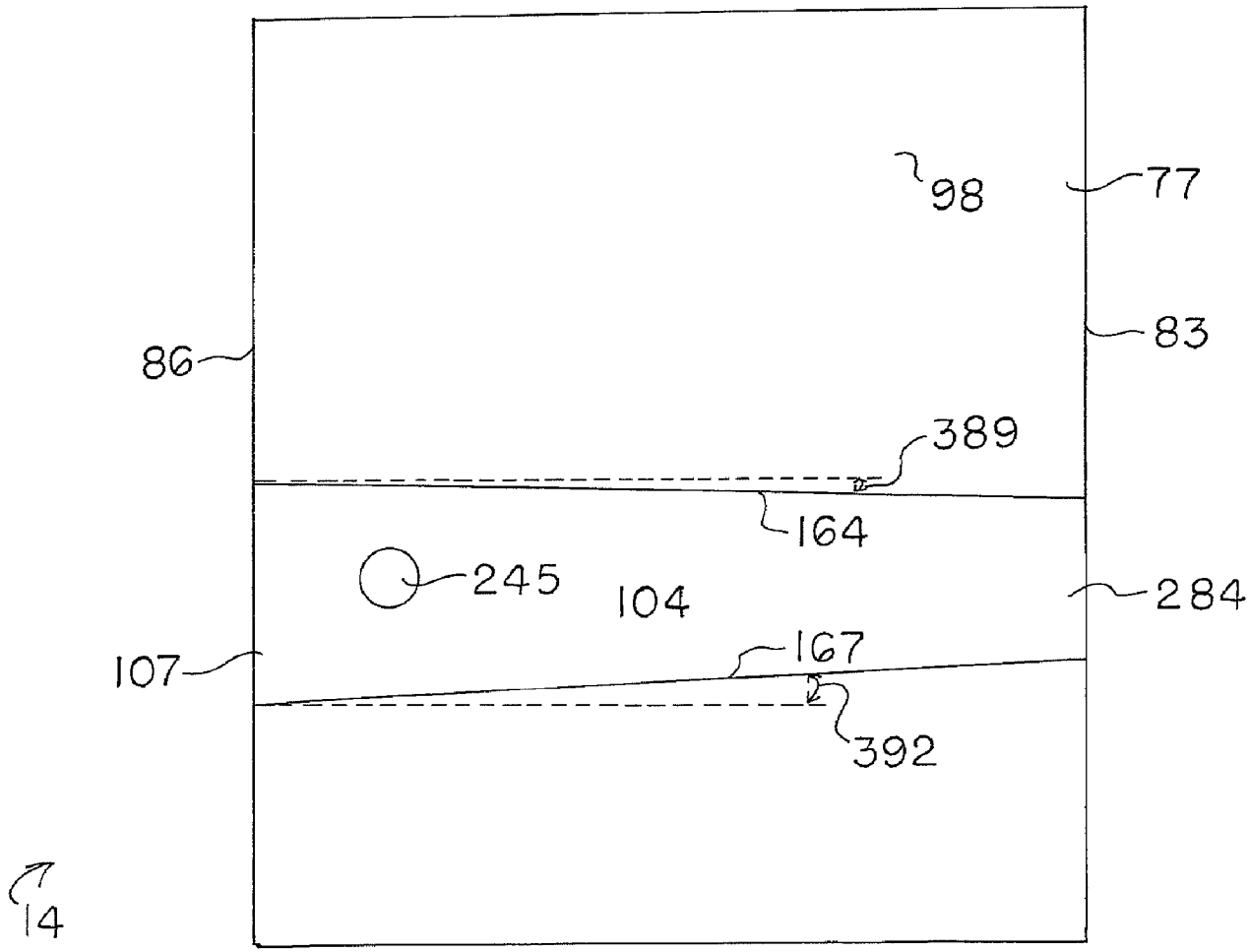
FIG. 19 is a representative elevational view of the first container sidewall of a container similar to that of FIG. 4, but in which the edges of the upper and lower channel surfaces are not beveled.

The upper and lower channel surfaces of the first and second elongated channels of the container may in each case be further described as having a taper angle relative to horizontal. For purposes of illustration and with reference to FIG. 19, with first elongated channel 104: upper channel surface 164 has a downward taper angle 389 relative to horizontal (e.g., as represented by the upper dashed line) from rear container wall 86 to front container wall 83; and lower channel surface 167 has an upward taper angle 392 relative to horizontal (e.g., as represented by the lower dashed line) from rear container wall 86 to front container wall 83. The description of the taper angles (389, 392) associated with first elongated channel 104, is substantially equivalently applicable to the taper angles (not illustrated in the drawings) of the upper 170 and lower 173 channel surfaces of the second elongated channel 110.

For a given elongated channel, or, as between the first and second elongated channels, the taper angles for the upper and lower channel surfaces may be the same or different. For example, in an embodiment, for each elongated channel, the taper angles of the upper and lower surfaces have different values; while at the same time, the upper channel surfaces of the first and second elongated channels each have substantially the same downward taper angle value, and the lower channel surfaces of the first and second elongated channels each have substantially the same upward taper angle value. In an embodiment, the taper angles of the upper and lower channel surfaces of the first and second elongated channels, in each case, have substantially the same value.

The downward taper angle (e.g., 389) of the upper channel surface of the first elongated channel and the second elongated channel may in each case independently have a value of from 0° to 10°, typically from 0.5° to 8°, and more typically, from 0.75° to 5°. The upward taper angle (e.g., 392) of the lower channel surface of the first elongated channel and the second elongated channel may in each case independently have a value of from 0° to 10°, typically, from 0.1° to 5°, and, more typically, from 0.2° to 3°. In a particular embodiment of the present invention, the downward taper angle of the upper surface of the first and second elongated channels in each case has a value of 2°, and the upward taper angle of the lower surface of the first and second elongated channels in each case has a value of 0.4°.

First elongated tube 32 has a rear tube portion 176, a front tube portion 179, an exterior upper tube surface 182, and an exterior lower tube surface 185. See, for example, FIGS. 9 and 10. Exterior upper tube surface 182 and exterior lower tube surface 185 of first elongated tube 32 taper towards each other from rear tube portion 176 to front tube portion 179 thereof. Second elongated tube 44 has a rear tube portion 188, a front tube portion 191, an exterior upper tube surface 194, and an exterior lower tube surface 197. Exterior upper tube surface 194 and exterior lower tube surface 197 of second elongated tube 44 taper towards each other from rear tube portion 188 to front tube portion 191 thereof. See, for example, FIG. 9.

Figure 20:
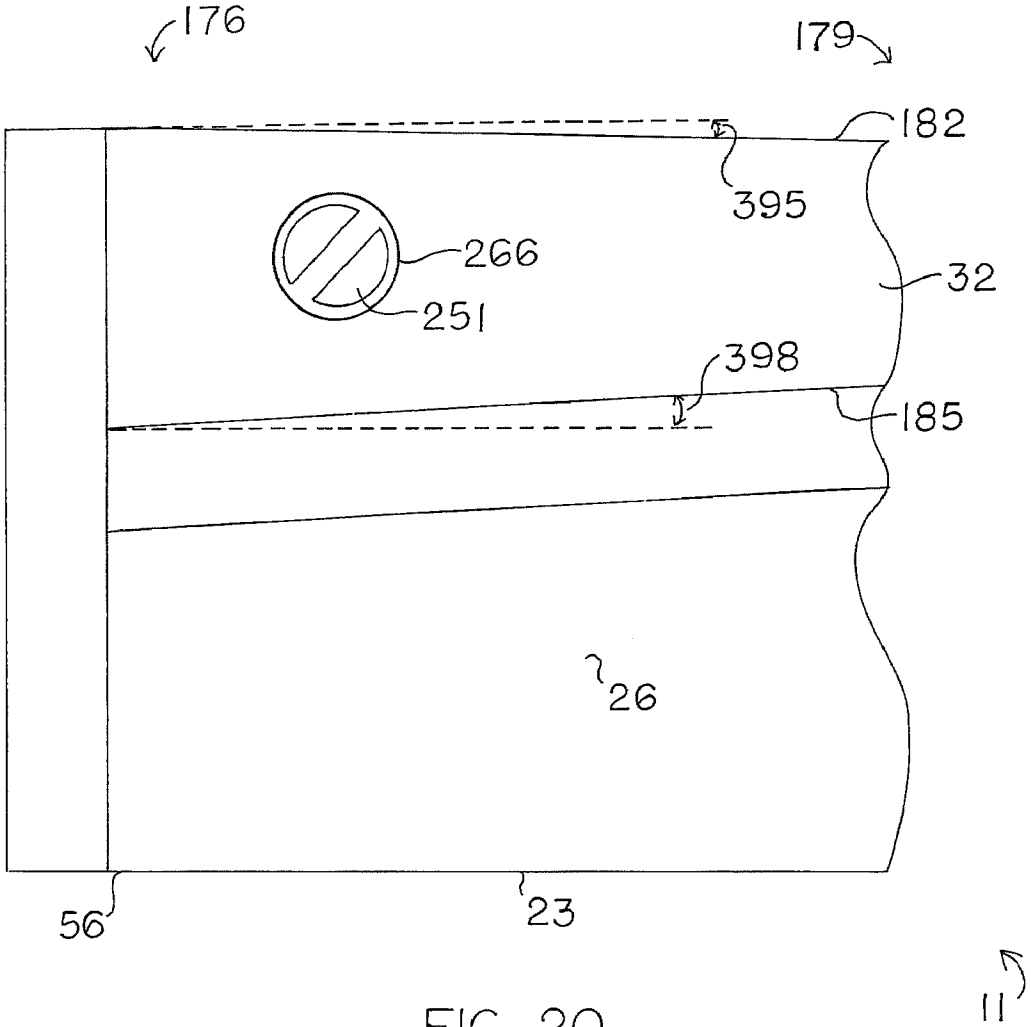
FIG. 20 is a representative elevational view of a portion of the first support sidewall side of a support structure similar to that of FIG. 10, but in which the edges of the exterior upper and lower tube surfaces are not beveled.

The exterior upper and lower tube surfaces of the first and second elongated tubes of the support structure may in each case be further described as having a taper angle relative to horizontal. For purposes of illustration and with reference to FIG. 20, with first elongated tube 32: exterior upper tube surface 182 has a downward taper angle 395 relative to horizontal (e.g., as represented by the upper dashed line) from rear tube portion 176 to front tube portion 179; and exterior lower tube surface 185 has an upward taper angle 398 relative to horizontal (e.g., as represented by the lower dashed line) from rear tube portion 176 to front tube portion 179. The description of the taper angles (395, 398) associated with first elongated tube 32, is substantially equivalently applicable to the taper angles (not illustrated in the drawings) of the exterior upper 194 and lower 197 tube surfaces of the of the second elongated tube 44.

For a given elongated tube, or, as between the first and second elongated tubes, the taper angles of the exterior upper and lower tube surfaces may be the same or different. For example, in an embodiment, for each elongated tube, the taper angles of the exterior upper and lower tube surfaces have different values; while at the same time, the exterior upper tube surfaces of the first and second elongated tubes each have substantially the same downward taper angle value, and the exterior lower tube surfaces of the first and second elongated tubes each have substantially the same upward taper angle value. In an embodiment, the taper angles of the exterior upper and lower tube surfaces of the first and second elongated tubes in each case have substantially the same value.

The downward taper angle (e.g., 395) of the exterior upper tube surface of the first elongated tube and the second elongated tube may in each case independently have a value of from 0° to 10°, typically, from 0.5° to 8°, and, more typically, from 0.75° to 5°. The upward taper angle (e.g., 398) of the exterior lower tube surface of the first elongated tube and the second elongated tube may in each case independently have a value of from 0° to 10°, typically, from 0.1° to 5°, and, more typically, from 0.2° to 3°. In a particular embodiment of the present invention, the downward taper angle of the exterior upper tube surface of the first and second elongated tubes in each case has a value of 2°, and the upward taper angle of the exterior lower tube surface of the first and second elongated tubes in each case has a value of 0.4°.

Front tube portion 179 of first elongated tube 32 is received through first open end 107 of first elongated channel 104. With first elongated tube 32 reversibly residing within first elongated channel 104, exterior upper tube surface 182 of first elongated tube 32 abuts upper channel surface 164 of first elongated channel 104. Correspondingly, exterior lower tube surface 185 of first elongated tube 32 abuts lower channel surface 167 of first elongated channel 104. As such, tapered first elongated tube 32 and tapered first elongated channel 104 have a tapered and abutting fit there-between.

Front tube portion 191 of second elongated tube 44 is received through first open end 113 of second elongated channel 110. With second elongated tube 44 reversibly residing within second elongated channel 110, exterior upper tube surface 194 of second elongated tube 44 abuts upper channel surface 170 of second elongated channel 110. Correspondingly, exterior lower tube surface 197 of second elongated tube 44 abuts lower channel surface 173 of second elongated channel 110. As such, tapered second elongated tube 44 and tapered second elongated channel 110 have a tapered and abutting fit there-between.

The tapered and abutting fit, between first elongated tube 32 and first elongated channel 104, and between second elongated tube 44 and second elongated channel 110, limits the linear extent to which container 14 may be slid into support structure interior 62. In addition, the tapered and abutting fit between the elongated tubes and associated elongated channels, serves to align apertures in the elongated tubes with apertures in the container sidewalls, through-which separate retaining pins may be received, as will be described in further detail herein.

In addition to being defined by upper and lower channel surfaces, the first and second elongated channels may each be independently further defined by an inner channel surface. With the first elongated channel, the upper channel surface and the lower channel surface thereof each independently have a lateral outwardly extending distance relative to the inner channel surface (of the first elongated channel). The lateral outwardly extending distance of the upper channel surface may be greater than, equivalent to or less than the lateral outwardly extending distance of the lower channel surface, of the first elongated channel. In an embodiment, the outwardly extending distance of the upper channel surface is greater than the outwardly extending distance of the lower channel surface of the first elongated channel, in which case the upper channel surface defines an outwardly extending upper shoulder of the first elongated channel.

With the second elongated channel, the upper channel surface and the lower channel surface thereof each independently have a lateral outwardly extending distance relative to the inner channel surface (of the second elongated channel). The lateral outwardly extending distance of the upper channel surface may be greater than, equivalent to or less than the lateral outwardly extending distance of the lower channel surface, of the second elongated channel. In an embodiment, the outwardly extending distance of the upper channel surface is greater than the outwardly extending distance of the lower channel surface of the second elongated channel, in which case the upper channel surface defines an outwardly extending upper shoulder of the second elongated channel. The outwardly extending shoulders of the first and second elongated channels each serve to increase the amount of upper channel surface area that abuts and rests upon the associated and underlying first or second elongated tube, thus improving the support and stability that the support structure provides to the container (via the first and second elongated tubes).

With reference to FIG. 3, in addition to upper channel surface 164 and lower channel surface 167, first elongated channel 104 is further defined by inner channel surface 200. Upper channel surface 164 has a lateral outwardly extending distance 203 relative to inner channel surface 200, and lower channel surface 167 has a lateral outwardly extending distance 206 relative to inner channel surface 200, of first elongated channel 104. Lateral outwardly extending distance 203 of upper channel surface 164 may be greater than, equivalent to or less than the lateral outwardly extending distance 206 of lower channel surface 167, of first elongated channel 104. In a particular embodiment, lateral outwardly extending distance 203 of upper channel surface 164, is greater than lateral outwardly extending distance 206 of lower channel surface 167, of first elongated channel 104. With lateral outwardly extending distance 203 of upper channel surface 164, being greater than lateral outwardly extending distance 206 of lower channel surface 167, upper channel surface 164 defines an outwardly extending upper shoulder 209.

With further reference to FIG. 3, in addition to upper channel surface 170 and lower channel surface 173, second elongated channel 110 is further defined by inner channel surface 212. Upper channel surface 170 has a lateral outwardly extending distance 215 relative to inner channel surface 212, and lower channel surface 173 has a lateral outwardly extending distance 218 relative to inner channel surface 212, of second elongated channel 110. Lateral outwardly extending distance 215 of upper channel surface 170 may be greater than, equivalent to or less than the lateral outwardly extending distance 218 of lower channel surface 173, of second elongated channel 110. In a particular embodiment, lateral outwardly extending distance 215 of upper channel surface 173, is greater than lateral outwardly extending distance 218 of lower channel surface 173, of second elongated channel 110. With lateral outwardly extending distance 215 of upper channel surface 170, being greater than lateral outwardly extending distance 218 of lower channel surface 173, upper channel surface 170 defines an outwardly extending upper shoulder 221.

Upper channel surface 164, and correspondingly the outwardly extending upper shoulder 209 defined thereby, of first elongated channel 107 abuts and rests on exterior upper tube surface 182 of first elongated tube 32. Similarly, upper channel surface 170, and correspondingly the outwardly extending upper shoulder 221 defined thereby, of second elongated channel 110 abuts and rests on exterior upper tube surface 194 of second elongated tube 44.

In an embodiment, upper channel surface 164 of first elongated channel 104 may have a lateral outwardly extending distance 203 (relative to inner channel surface 200) of from 2 cm to 40 cm, typically, from 5 cm to 30 cm, and, more typically, from 10 cm to 25 cm. Lower channel surface 167 of elongated channel 104 may have an outwardly extending distance 206 (relative to inner channel surface 200) of from 1 cm to 20 cm, typically, from 2 cm to 15 cm, and, more typically, from 3 cm to 10 cm. In an embodiment, with first elongated channel 104: upper channel surface 164 thereof has a lateral outwardly extending distance 203 of 19.6 cm; and lower channel surface 167 thereof has a lateral outwardly extending distance 206 of 6.6 cm.

Upper channel surface 170 of second elongated channel 110 may have a lateral outwardly extending distance 215 (relative to inner channel surface 212) of from 2 cm to 40 cm, typically from 5 cm to 30 cm, and more typically from 10 cm to 25 cm. Lower channel surface 173 of second elongated channel 110 may have a laterally outwardly extending distance 218 (relative to inner channel surface 212) of from 1 cm to 20 cm, typically, from 2 cm to 15 cm, and, more typically, from 3 cm to 10 cm. In an embodiment, with second elongated channel 110: upper channel surface 170 thereof has a lateral outwardly extending distance 215 of 19.6 cm; and lower channel surface 173 thereof has a lateral outwardly extending distance 218 of 6.6 cm.

The first and second elongated tubes of the support structure may each have apertures, that are aligned with apertures in the associated first and second container sidewalls of the container. The aligned apertures of the first elongated tube and the first container sidewall may have a first retaining pin received and residing therein. Correspondingly, the aligned apertures of the second elongated tube and the second container sidewall may have a second retaining pin received and residing therein. Receipt of the retaining pins within the aligned apertures serves to substantially prevent longitudinal movement of the first and second elongated tubes within the associated first and second elongated channels, thereby retaining the container within the support structure interior of the support structure.

More particularly, the first elongated tube and the second elongated tube each independently have a tube wall, which in each case has an inboard tube wall portion and an outboard tube wall portion. The inboard tube wall portion of the first elongated tube faces towards the support structure interior, and the outboard tube wall portion of the first elongated tube faces away from (or outward relative to) the support structure interior. The inboard tube wall portion of the second elongated tube faces towards the support structure interior, and the outboard tube wall portion of the second elongated tube faces away from (or outward relative to) the support structure interior.

The inboard tube wall portion of the first elongated tube has an aperture, and a portion of the first container sidewall defining the first elongated channel has an aperture that is aligned with the aperture of the inboard tube wall portion of the first elongated tube and together form a pair of aligned first tube-first channel apertures. A first retaining pin is received and resides within the pair of aligned first tube-first channel apertures. The inboard tube wall portion of the second elongated tube has an aperture, and a portion of the second container sidewall defining the second elongated channel has an aperture that is aligned with the aperture of the inboard tube wall portion of the second elongated tube and together form a pair of aligned second tube-second channel apertures. A second retaining pin resides within the pair of aligned second tube-second channel apertures.

The first retaining pin substantially prevents longitudinal movement of the first elongated tube within the first elongated channel. Similarly, the second retaining pin substantially prevents longitudinal movement of the second elongated tube within the second elongated channel. Correspondingly, the first and second retaining pins, residing within the so-aligned apertures, also substantially prevents movement of, and retains the container within the support structure interior.

With reference to the drawings (e.g., FIGS. 9 and 11) first elongated tube 32 has a tube wall 224 that has an inboard tube wall portion 227, and an outboard tube wall portion 230. With first elongated tube 32, the inboard tube wall portion 227 thereof faces towards support structure interior 62, and the outboard tube wall portion 230 thereof faces away from (or outward relative to) support structure interior 62. Second elongated tube 44 has a tube wall 233 that has an inboard tube wall portion 236 and an outboard tube wall portion 239. With second elongated tube 44, the inboard tube wall portion 236 thereof faces towards support structure interior 62, and the outboard tube wall portion 239 thereof faces away from (or outward relative to) support structure interior 62.

Figure 4:
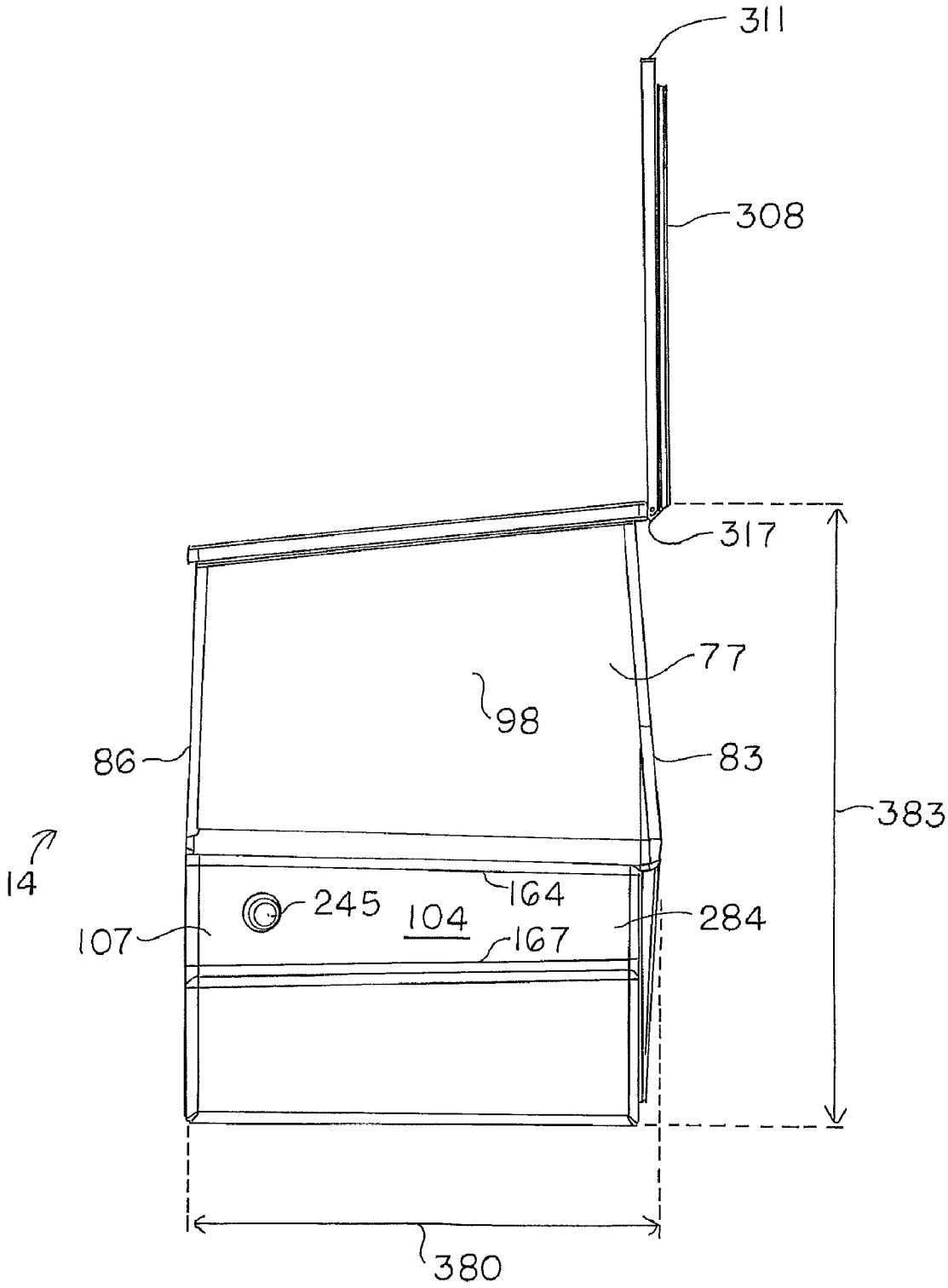
FIG. 4 is a representative elevational view towards the first container sidewall of the container of FIG. 3.
Figure 7:
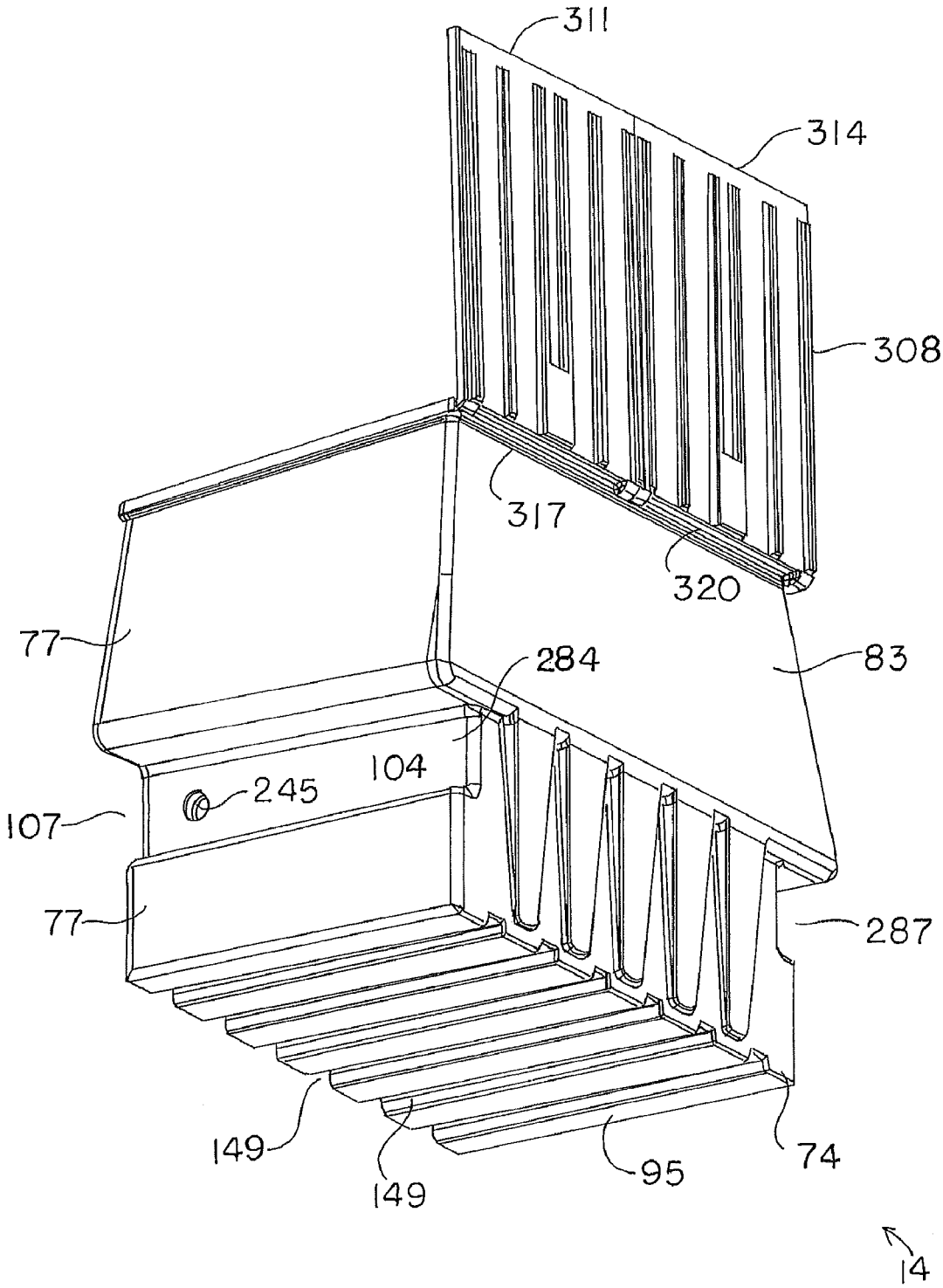
FIG. 7 is a representative perspective view of the container alone of FIG. 1, showing the lower surface of the container base thereof.

Inboard tube wall portion 227 of first elongated tube 32 has an aperture 242 (FIG. 9). A portion of first container sidewall 77 that defines first elongated channel 104 has an aperture 245 (FIGS. 4 and 7). Aperture 245 resides within first elongated channel 104. Aperture 245, residing within first elongated channel 104, is aligned with aperture 242 of inboard tube wall portion 227 of first elongated tube 32, and together form (or define) a pair of aligned first tube-first channel apertures 248. A first retaining pin 251 is received and resides within the pair of aligned first tube-first channel apertures 248. See, for example, FIGS. 1, 12*a* and 12*b*. The first retaining pin and the pair of aligned first tube-first channel apertures may have matching threads (not shown) that serve to better retain the first retaining pin within the pair of aligned first tube-first channel apertures.

Figure 5:
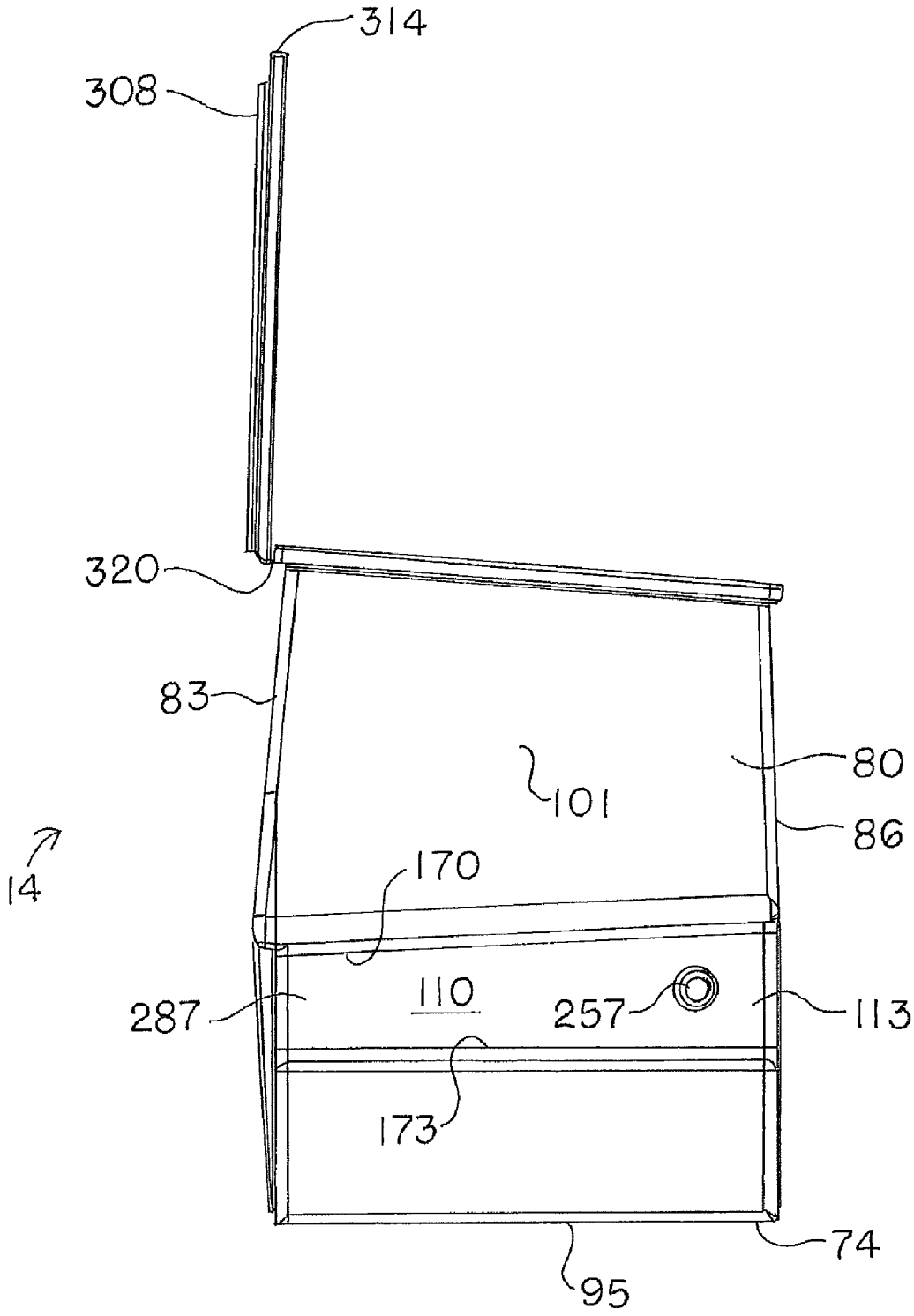
FIG. 5 is a representative elevational view towards the second container sidewall of the container of FIG. 3.
Figure 6:
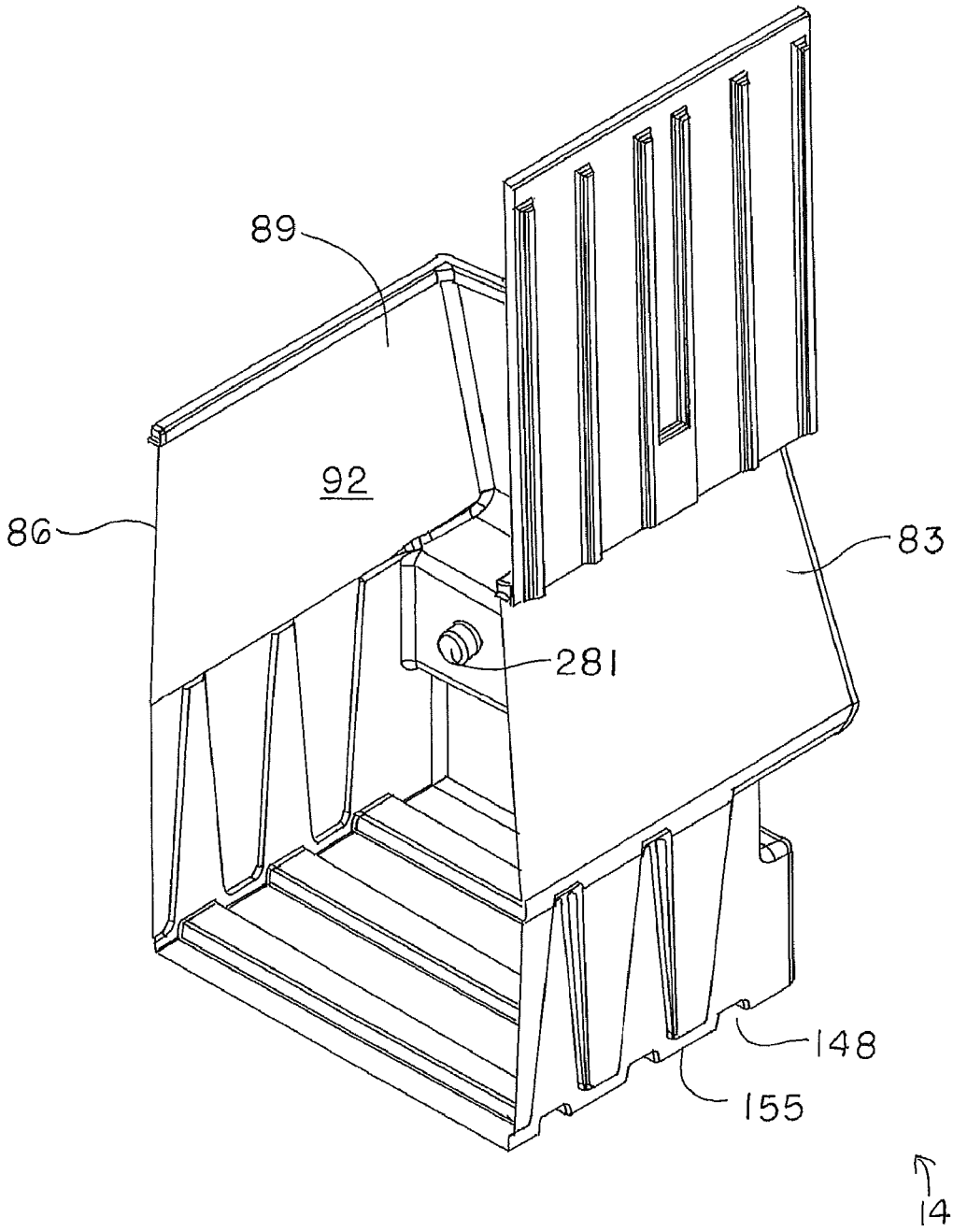
FIG. 6 is a representative perspective sectional view of the container alone of FIG. 1, showing a portion of the container interior.

Inboard tube wall portion 236 of second elongated tube 44 has an aperture 254 (FIGS. 1 and 9). A portion of second container sidewall 80 that defines second elongated channel 110 has an aperture 257 (FIG. 5). Aperture 257 resides within second elongated channel 110. Aperture 257, residing within second elongated channel 110, is aligned with aperture 254 of inboard tube wall portion 236 of second elongated tube 44, and together form (or define) a pair of aligned second tube-second channel apertures 260. A second retaining pin 263 is received and resides within the pair of aligned second tube-second channel apertures 260. See, for example, FIGS. 1, 13*a* and 13*b*. The second retaining pin and the pair of aligned second tube-second channel apertures may have matching threads (not shown) that serve to better retain the second retaining pin within the pair of aligned second tube-second channel apertures.

Depending on the location of the pair of aligned tube-channel apertures, access thereto and introduction of the retaining pins therein may be achieved through the first open ends (38, 50), and/or the second open ends (158, 161) of the first and second elongated tubes (32, 44). As depicted in the drawings, each pair of aligned tube-channel apertures (248, 260) are positioned towards the rear tube portion (176, 188) of each elongated tube (32, 44), and may be accessed via the second open ends (158, 161) of the first and second elongated tubes (32, 44).

To improve ease of accessing each pair of aligned tube-channel apertures, the outboard tube wall portion of each elongated tube may be provided with an aperture that is aligned with the pair of aligned tube-channel apertures. The retaining pin may be introduced directly through the appropriately dimensioned outboard tube wall portion aperture and into the pair of aligned tube-channel apertures.

More particularly, the outboard tube wall portion of the first elongated tube comprises an aperture that is aligned with the aperture of the inboard tube wall portion of the first elongated tube. Correspondingly, the aperture of the outboard tube wall portion of the first elongated tube is also aligned with the pair of aligned first tube-first channel apertures. The aperture of the outboard tube wall portion of the first elongated tube is dimensioned to receive the first retaining pin there-through.

The outboard tube wall portion of the second elongated tube comprises an aperture that is aligned with the aperture of the inboard tube wall portion of the second elongated tube. Correspondingly, the aperture of the outboard tube wall portion of the second elongated tube is also aligned with the pair of aligned second tube-second channel apertures. The aperture of the outboard tube wall portion of the second elongated tube is dimensioned to receive the second retaining pin there-through.

Figure 12B:
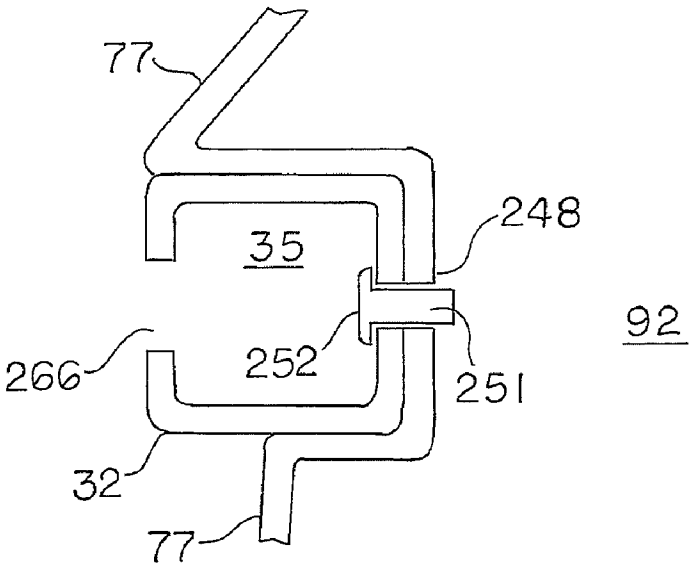
Figure 12A:
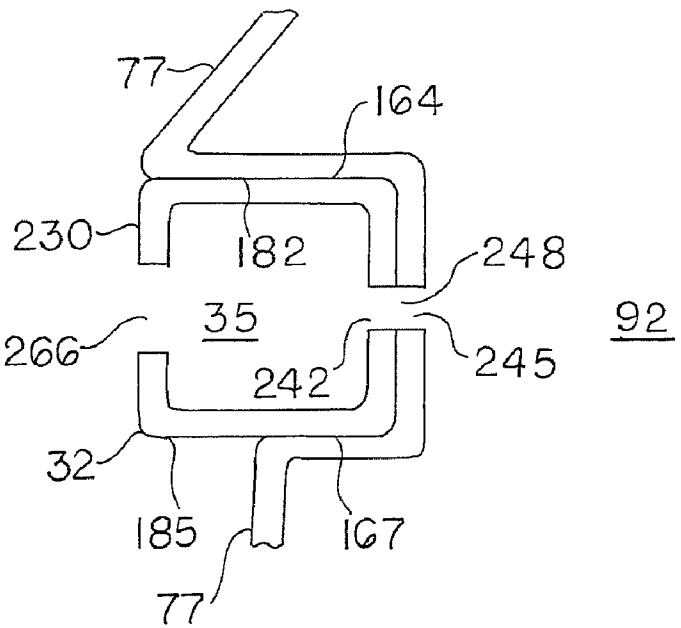

With reference to the drawings, outboard tube wall portion 230 of first elongated tube 32 includes an aperture 266 that is aligned with aperture 242 of the inboard tube wall portion 227 of first elongated tube 32. Aperture 266, of outboard tube wall portion 230, is also aligned with the pair of aligned first tube-second channel apertures 248. Aperture 266, of outboard tube wall portion 230, is dimensioned to receive first retaining pin 251 there-through. Typically, first retaining pin 251 has a first retaining pin head 252, and outboard aperture 266 is dimensioned to allow first retaining pin head 252 to pass there-through (FIG. 12*b*).

Figure 13B:
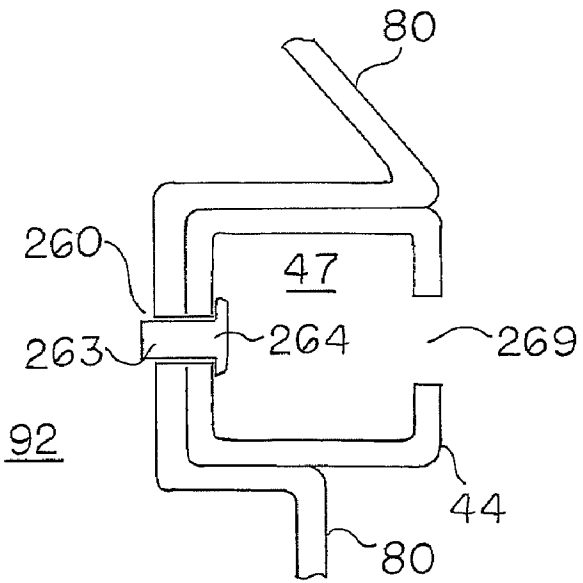
Figure 13A:
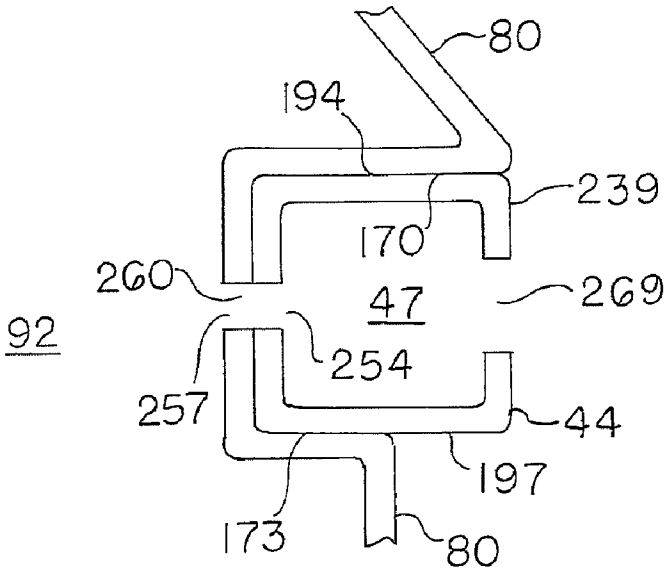

Outboard tube wall portion 239 of second elongated tube 44 includes an aperture 269 that is aligned with aperture 254 of the inboard tube wall portion 236 of second elongated tube 44. Aperture 269, of outboard tube wall portion 239, is also aligned with the pair of aligned second tube-second channel apertures 260. Aperture 269, of outboard tube wall portion 239, is dimensioned to receive second retaining pin 263 there-through. Typically, second retaining pin 263 has a second retaining head 264, and outboard aperture 266 is dimensioned to allow second retaining pin head 264 to pass there-through (FIG. 13*b*).

In an embodiment, a portion of the retaining pins that are received through and reside within each pair of aligned tube-channel apertures, extends out into the container interior space (e.g., 92). See for example, FIGS. 12*b* and 13*b*. To protect the retaining pins from damage that may result, for example, from exposure to or impacts with refuse introduced into the container interior space, the retaining pins may be received within the chamber of a housing.

In a particular embodiment, the aperture of the first elongated channel is in communication with a first chamber of a first housing that is dimensioned and positioned to receive a portion of the first retaining pin therein. In addition, the aperture of the second elongated channel is in communication with a second chamber of a second housing that is dimensioned and positioned to receive a portion of the second retaining pin therein.

Figure 14B:
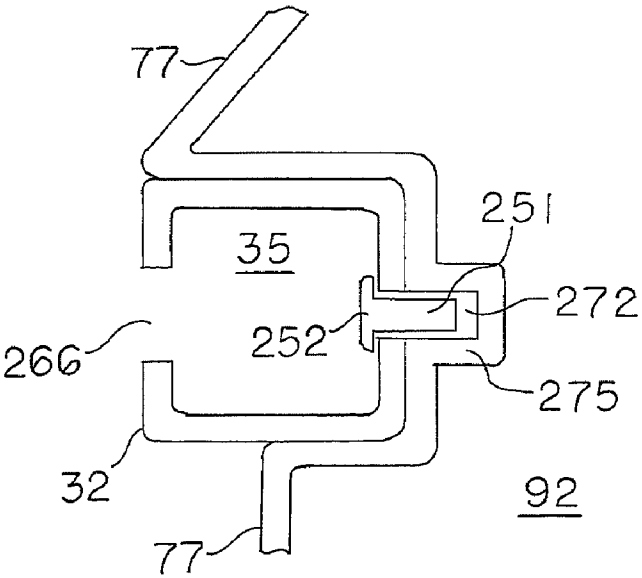
FIGS. 14*a* and 14*b* are sectional representations of a pair of aligned first tube-first channel apertures, in which, the first channel aperture is in communication with a first recess, and further without and with the first retaining pin received there-through and residing therein.
Figure 14A:
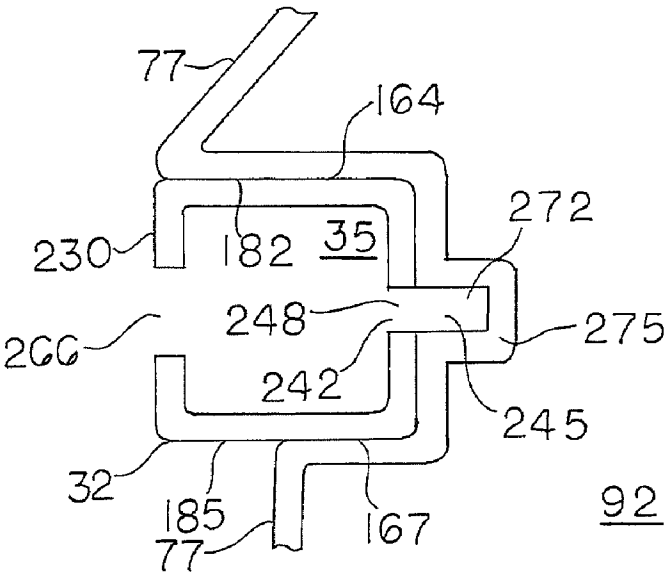

With reference to FIGS. 14*a* and 14*b*, aperture 245 of first elongated channel 104 of first container sidewall 77 is in communication with a first chamber 272 that resides within and is defined by a first housing 275. First chamber 272 is dimensioned and positioned to receive a portion of first retaining pin 251 therein. Since aperture 242, of inboard tube wall portion 227 of first elongated tube 33, is aligned with aperture 245 of first channel 104, aperture 242 is also in communication with first chamber 272 of first housing 275. Accordingly, the pair of aligned first tube-first channel apertures 248 is also in communication with first chamber 272 of first housing 275. First retaining pin 251 extends through the pair of aligned first tube-first channel apertures 248 and into first chamber 272. The first retaining pin, the pair of aligned first tube-first channel apertures and the interior walls of the first chamber may have matching threads (not shown) that serve to better retain the first retaining pin within the pair of aligned first tube-first channel apertures and the first chamber.

Figure 15B:
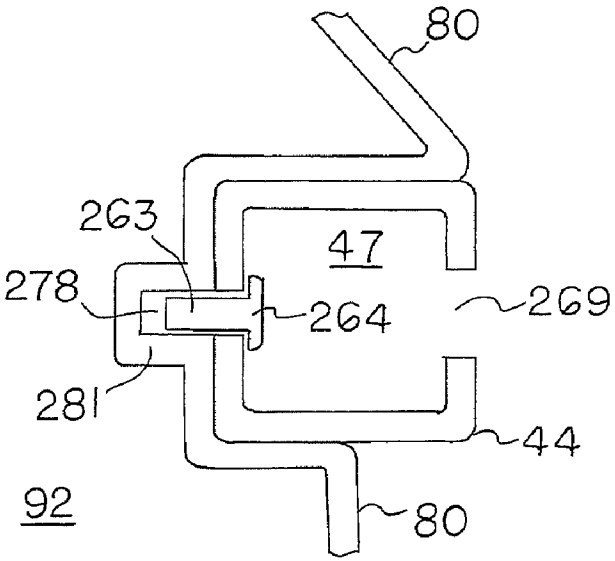
FIGS. 15*a* and 15*b* are sectional representations of a pair of aligned second tube-second channel apertures, in which, the second channel aperture is in communication with a second recess, and further without and with the second retaining pin received there-through and residing therein.
Figure 15A:
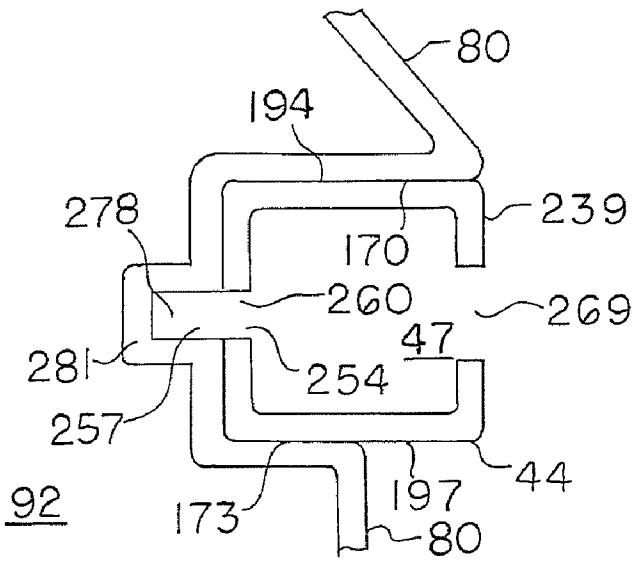

With reference to FIGS. 15*a* and 15*b*, aperture 257 of second elongated channel 110 of second container sidewall 80 is in communication with a second chamber 278 that resides within and is defined by a second housing 281. A perspective view of second housing 281 of second elongated channel 110 is visible in the sectional perspective view of container 14 of FIG. 6. Second chamber 278 is dimensioned and positioned to receive a portion of second retaining pin 263 therein. Since aperture 254, of inboard tube wall portion 236 of second elongated tube 44, is aligned with aperture 257 of second channel 110, aperture 254 is also in communication with second chamber 278 of second housing 281. Accordingly, the pair of aligned second tube-second channel apertures 260 is also in communication with second chamber 278 of second housing 281. Second retaining pin 263 extends through the pair of aligned second tube-second channel apertures 260 and into second chamber 278. The second retaining pin, the pair of aligned second tube-second channel apertures and the interior walls of the second chamber may have matching threads (not shown) that serve to better retain the second retaining pin within the pair of aligned second tube-second channel apertures and the second chamber.

With the container assembly of the present invention assembled, the first and second elongated tubes (32, 44) of the support structure (11) each pass through the first open ends (107, 113) of and reside within the first and second elongated channels (104, 110) of the first and second container sidewalls (77, 80) of the container (14). Typically, the first open ends (38, 50) of the first and second elongated tubes (32, 44) are each positioned, within the elongated channels (107, 113), facing towards the front container wall (83) of the container. To provide access (or improved access) to the first open ends of the first and second elongated tubes (and accordingly the elongated hollow interiors thereof), the first and second elongated channels may each have a second open end that is positioned in each case along the front container wall of the container. The second open end of each elongated channel is, typically, dimensioned so as to allow a lift member, such as, a lift fork, to pass there-through, and then through the first open end and into the elongated hollow interior of the associated elongated tube, thereby allowing the container assembly to be lifted.

In a particular embodiment, the first elongated channel has a second open end along the front container wall. The second open end of the first elongated channel provides access to the first open end of the first elongated tube (that resides within the first elongated channel). Additionally, the second elongated channel has a second open end along the front container wall. The second open end of the second elongated channel provides access to the first open end of the first elongated tube (that resides within the second elongated channel).

With reference to FIGS. 2, 4 and 7, first elongated channel 104 has, in addition to first open end 107, a second open end 284. Second open end 284 of first elongated channel 104 is positioned along front container wall 83, and provides access to first open end 38 of first elongated tube 32, which resides within first elongated channel 104. A lift member, such as, first lift member 119, may be passed through second open end 284 of first elongated channel 104, through first open end 38 and into elongated hollow interior 35 of first elongated tube 32. See, for example, FIG. 2.

With reference to FIGS. 2, 5 and 7, in addition to first open end 113, second elongated channel 110 has a second open end 287. Second open end 287 of second elongated channel 110 is positioned along front container wall 83, and provides access to first open end 50 of second elongated tube 44, which resides within second elongated channel 110. A lift member, such as second lift member 122, may be passed through second open end 287 of second elongated channel 110, through first open end 50 and into elongated hollow interior 47 of second elongated tube 44.

The first and second elongated tubes may each independently extend substantially the entire length of (e.g., being substantially coextensive with) the elongated channel in which they each reside. When extending substantially the entire length of the associated elongated channel, the first open end of the elongated tube may be described as being substantially flush or even with the second open end of the associated elongated channel. Alternatively, the first and second elongated tubes may each independently extend less than the entire length of (e.g., being less than coextensive with) the elongated channel in which they each reside. When extending less than the entire length of the associated elongated channel, the first open end of the elongated tube may be described as being recessed within the associated elongated channel (e.g., being recessed relative to the second open end of the associated elongated channel). Further, alternatively, the first and second elongated tubes may each independently extend beyond the entire length of the elongated channel in which they each reside. When extending beyond the entire length of the associated elongated channel, the first open end of the elongated tube resides beyond or extends outward relative to the second open end of the associated elongated channel. Typically, the first and second elongated tubes each independently extend substantially the entire length, or extend less than the entire length of the associated elongated channel.

In an embodiment, the first open end of the first elongated tube is recessed within the first elongated channel relative to the second open end of the first elongated channel. Additionally, the first open end of the second elongated tube is recessed within the second elongated channel relative to the second open end of the second elongated channel.

Providing the container assembly with elongated tubes having first open ends that are recessed within the associated elongated channels, is beneficial for reasons including, but not limited to, weight reduction and/or aesthetics. With the first open ends of the elongated tubes so recessed, the elongated tubes are each shorter, comprise less material and, as such, contribute less weight to the assembly, compared to longer elongated tubes (e.g., having first open ends that are coextensive with the second open ends of the associated elongated channels). The recessed first open ends of the elongated tubes provide an elongated open channel space within the elongated channels (between the first open ends of the elongated tubes and the second open ends of the elongated channels) into which extensions of the upper container portions may extend and reside for aesthetic purposes, as will be discussed further herein.

With reference to FIG. 2, first open end 38 of first elongated tube 32 is recessed within first elongated channel 104, of first container sidewall 77 of container 14, relative to second open end 284 of first elongated channel 104. First elongated tube 32 extends less than the entire length of (e.g., being less than coextensive with) the first elongated channel 104 in which it resides. A first elongated open channel space 290 is formed within first elongated channel 104, between the recessed first open end 38 of first elongated tube 32 and second open end 284 of first elongated channel 104.

Figure 18:
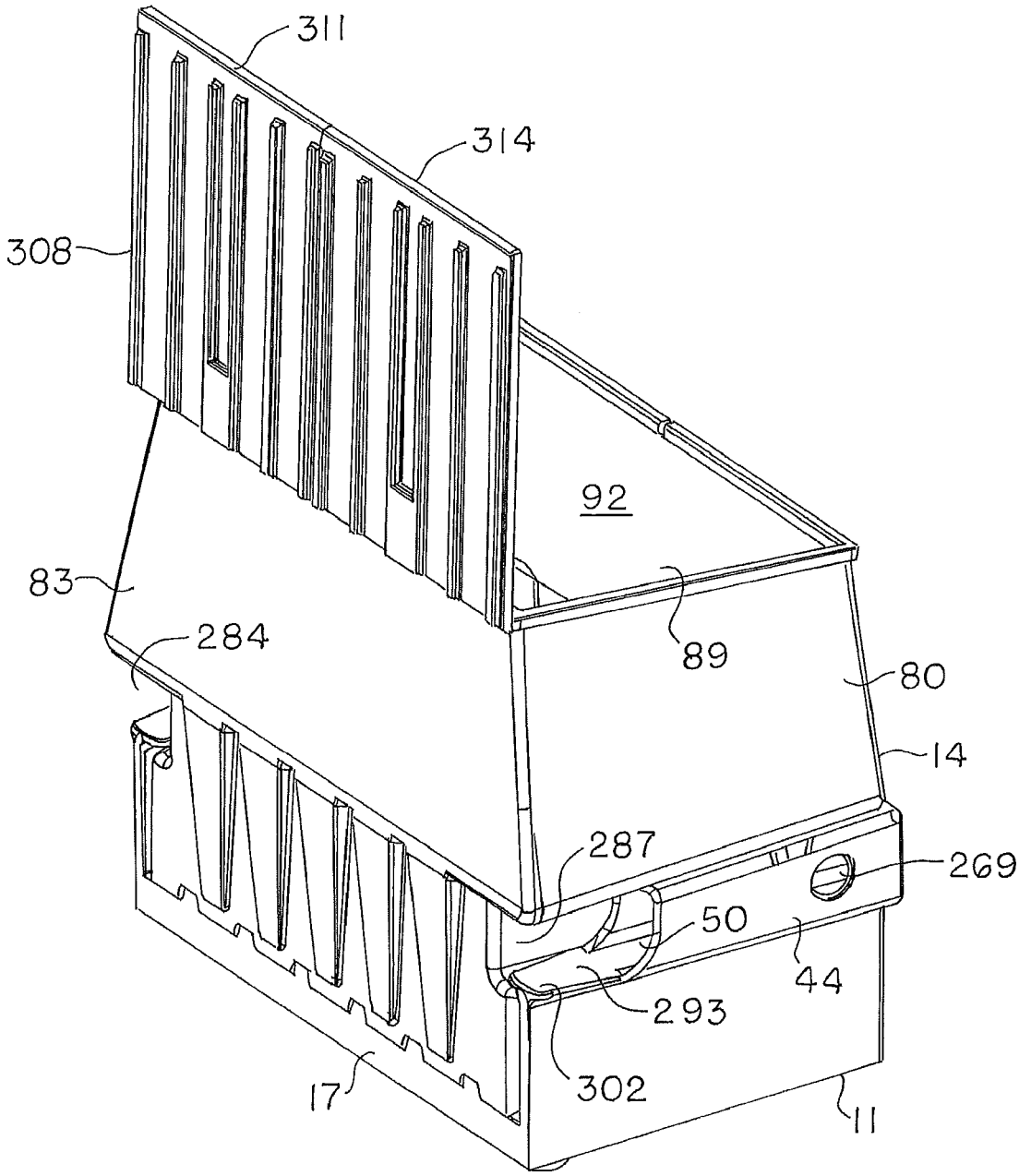
FIG. 18 is a representative perspective non-exploded view of the container assembly of FIG. 1, towards the second container sidewall side of the container.

With reference to FIG. 18, first open end 50 of second elongated tube 44 is recessed within second elongated channel 110, of second container sidewall 80 of container 14, relative to second open end 287 of second elongated channel 110. Second elongated tube 44 extends less than the entire length of (e.g., is less than coextensive with) the second elongated channel 110 in which it resides. A second elongated open channel space 293 is formed within second elongated channel 110, between the recessed first open end 50 of second elongated tube 44 and second open end 287 of second elongated channel 110.

The first and second elongated tubes may each further include a shelf that extends forward relative to the first open end of each elongated tube thereof. When the first open ends of the elongated tubes are recessed within the associated elongated channel (as described above), at least a portion of the shelf of each elongated tube resides within the associated elongated channel. The shelves of the elongated tubes provide, for example, a combination of weight reduction and dimensional stability to the container assembly. The forward shelf of each elongated tube, typically, has a lower shelf surface that abuts a portion of the lower channel surface of the elongated channel in which it resides, thereby serving to prevent or minimize vertical movement of the container within the support structure interior, thereby improving or maintaining the dimensional stability of the container assembly. An elongated tube having a shorter length coupled with a forward extending shelf, typically weighs less than, an elongated tube having no forward extending shelf and a length that is equivalent to the combined length of the shorter elongated tube and the forward extending shelf.

In an embodiment of the present invention, the first elongated tube further includes a first shelf that extends forward relative to the first open end of the first elongated tube. With the first open end (or front tube portion) of the first elongated tube recessed within the first elongated channel, the first shelf resides substantially within the first elongated channel. The second elongated tube also further includes a second shelf that extends forward relative to the first open end of the second elongated tube. With the first open end (or front tube portion) of the second elongated tube recessed within the second elongated channel, the second shelf resides substantially within the second elongated channel.

First elongated tube 32 may further include, in an embodiment, a first shelf 296 that extends forward relative to first open end 38 (and front tube portion or end 179) thereof. With first open end 38 (and front tube portion 179) of first elongated tube 32 recessed within first elongated channel 104, at least a portion of first shelf 296 resides within first elongated channel 104, and, more particularly, within first elongated open channel space 290 (FIG. 2). First forward shelf 296 has a lower shelf surface 299 that abuts a portion of lower channel surface 167 of first elongated channel 104.

Second elongated tube 44 further optionally includes, in an embodiment, a second shelf 302 that extends forward relative to first open end 50 (and front tube portion or end 191) thereof. With first open end 50 (and front tube portion 191) of second elongated tube 44 recessed within second elongated channel 110, at least a portion of second shelf 302 resides within second elongated channel 110, and, more particularly, within second elongated open channel space 293 (FIG. 18). Second forward shelf 302 has a lower shelf surface 305 that abuts a portion of lower channel surface 173 of second elongated channel 110.

The container of the container assembly may, optionally, further include a reversibly closable lid that reversibly closes the open container top. The reversibly closable lid may be attached to the container by means of a hinge. Alternatively, the reversibly closable lid may be substantially free of attachment to the container (e.g., free of hinged attachment to the container), in which case it is, typically, reversibly lifted off of the open container top.

With reference to, for example, FIGS. 1 and 18, container 14 includes a reversibly closable lid 308, that reversibly closes open container top 89. Reversibly closable lid 308 includes a first lid portion 311 and a second lid portion 314 that are each independently reversibly closeable relative to open container top 89. Reversibly closable lid 308 is hingedly attached to upper container portion 125 by a hinge. More particularly, first lid portion 311 is hingedly attached to upper container portion 125 by a first hinge 317 (FIGS. 4 and 7), and second lid portion 314 is hingedly attached to upper contain portion 125 by a second hinge 320 (FIGS. 5 and 7).

At least a portion of the container (e.g., the upper container portion) and/or at least a portion of the support structure (e.g., the rear support wall thereof) may have a shape that corresponds to a principle activity that is being conducted within the venue in which the container assembly is being used. For example, in the case of a sports venue, at least a portion of the container and/or the support structure may have: a sports ball shape (e.g., baseball, rugby ball, American football, soccer ball, or tennis ball shape); or a protective sports helmet shape (e.g., a hockey helmet, American football helmet, motorcycle helmet, or automotive racing helmet shape).

Figure 16:
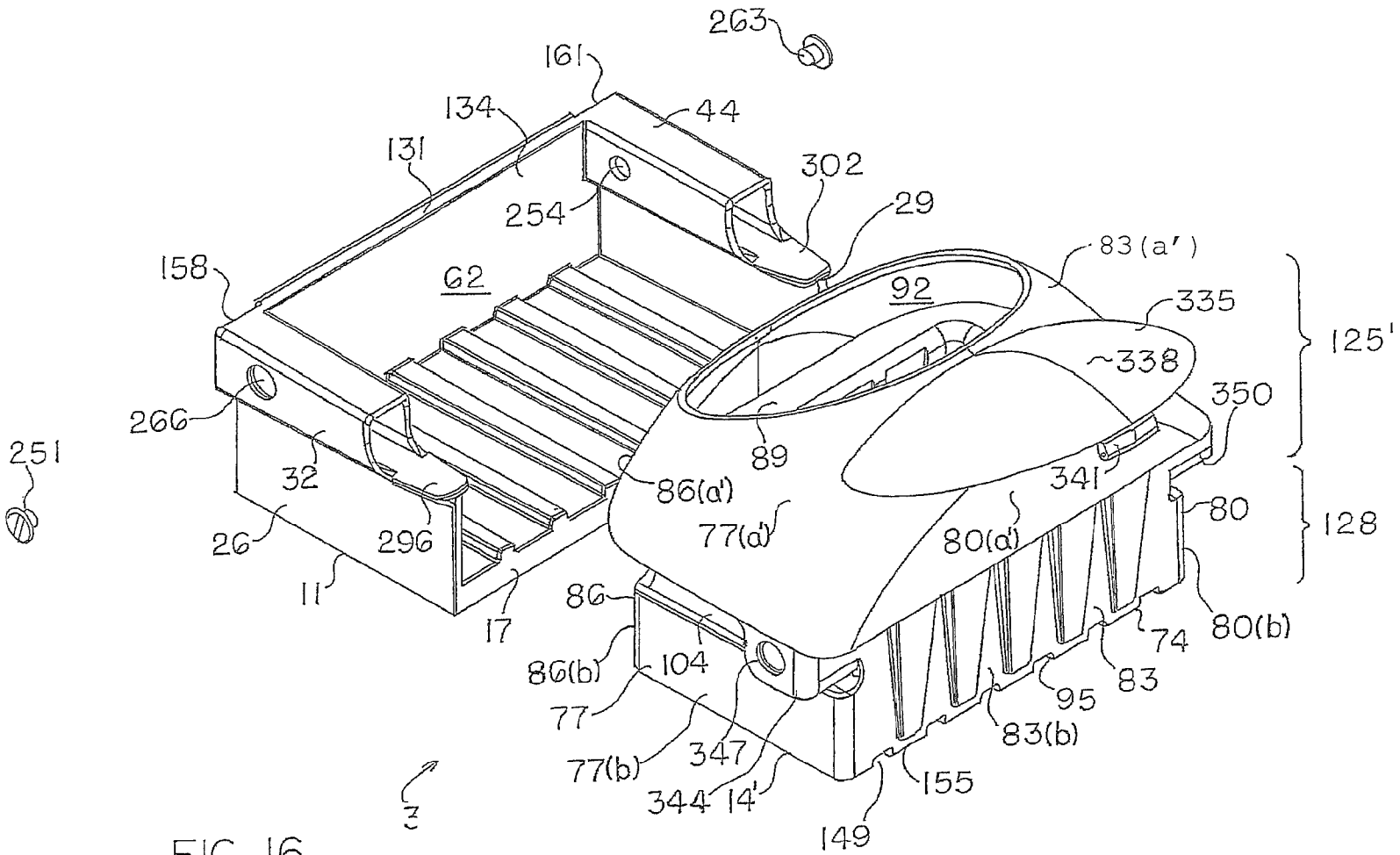
FIG. 16 is a representative perspective exploded view of a container assembly according to the present invention, in which, the upper portion of the container has a sports helmet shape.
Figure 17:
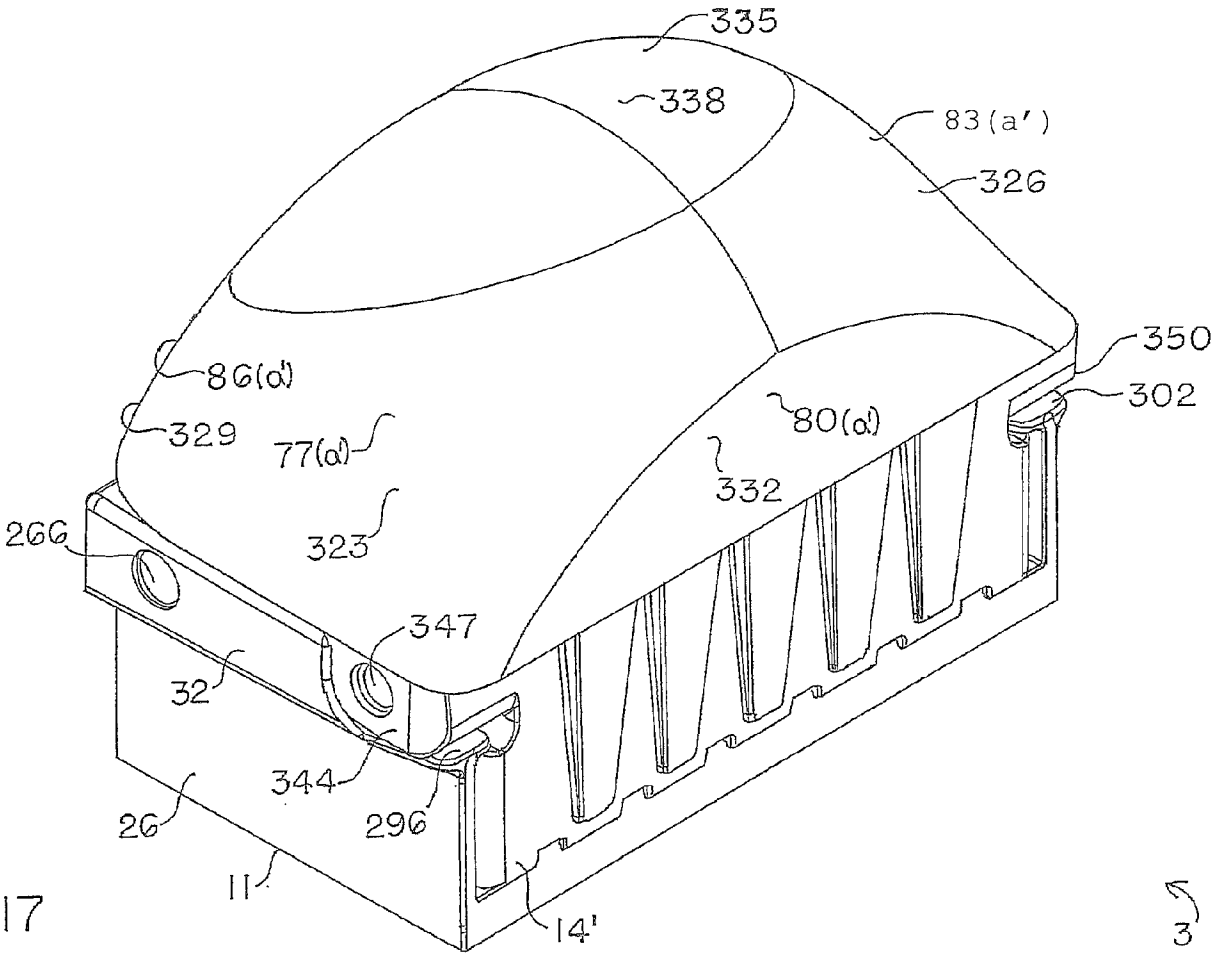
FIG. 17 is a representative perspective non-exploded view of the container assembly of FIG. 16.

In an embodiment, at least a portion of the container, and, in particular, the upper container portion has a protective sports helmet shape, such as, a hockey helmet shape or an American football helmet shape or a protective racing helmet shape. With reference to FIGS. 16 and 17, container assembly 3 includes a support structure 11, and a container 14'. Support structure 11 is as described previously herein with regard to container assembly 1. Container 14' is substantially as described previously herein with regard to container assembly 1, but the upper container portion 125' of container 14' has a protective sports helmet shape that generally represents a hockey helmet shape.

First container sidewall upper portion 77(*a'*), second container sidewall upper portion 80(*a'*), rear container wall upper portion 86(*a'*) and front container wall upper portion 83(*a'*) of container 14', and, in particular, the exterior surfaces thereof (e.g., first container sidewall upper portion exterior surface 323, second container sidewall upper portion exterior surface 326, rear container wall upper portion exterior surface 329 and front container wall upper portion exterior surface 332), together define a protective sports helmet shape that generally represents a hockey helmet shape. Reversibly closeable lid 335 of container 14', and, in particular, the exterior surface 338 thereof, has a dome-like shape that augments the protective sports helmet shape of upper container portion 125' of container 14', when lid 335 is closed over open container top 89. Reversibly closeable lid 335 includes a hinge element 341 that engages hingedly with a further hinge element (not shown) of upper portion 125' of container 14'.

To provide a particular shape, such as, a sports ball shape or protective sports helmet shape, the support structure and/or container of the container assembly of the present invention may further include aesthetic elements or components. For example, upper container portion 125' of container 14' includes, as substantially aesthetic elements: a first ear guard 344 having a first ear guard aperture 347; and a second ear guard 350 (only partially visible in the drawings) having a second ear guard aperture (not visible in the drawings). First and second ear guards (344, 350), have the general aesthetic shape of protective hockey helmet ear guards, and do not functionally act as ear guards.

First ear guard 344 extends downwardly from first container sidewall upper portion 77(*a'*) and resides within a portion of first elongated channel 104 that is opposite of first open end 107 of first elongated channel 104 (e.g., residing towards or flush with front container wall 83). First ear guard 344 substantially obstructs second open end 284 of first elongated channel 104. Second ear guard 350 (not fully visible in the drawings) has substantially the same shape and appearance of first ear guard 344. Second ear guard 350 extends downwardly from second container sidewall upper portion 80(*a'*) and resides within a portion of second elongated channel 110 that is opposite of first open end 113 of second elongated channel 110 (e.g., residing towards or flush with front container wall 83). Second ear guard 350 substantially obstructs second open end 287 of second elongated channel 110.

With container assembly 3 assembled (i.e., container 14', and, in particular, lower portion 128 thereof, residing within support structure 62) first shelf 296 of first elongated tube 32 resides beneath first ear guard 344, and second shelf 302 of second elongated tube 44 resides beneath second ear guard 350. First ear guard 344 may also be described as residing substantially within first elongated open channel space 290. Second ear guard 350 may also be described as residing substantially within second elongated open channel space 293.

In addition to substantially obstructing second open end 284 of first elongated channel 104, first ear guard 344 also substantially obstructs first open end 38 of first elongated tube 32. Correspondingly, in addition to substantially obstructing second open end 287 of second elongated channel 110, second ear guard 350 also substantially obstructs first open end 50 of second elongated tube 44. With the first open ends (38, 50) of the first and second elongated tubes (32, 44) substantially obstructed by the first and second ear guards (344, 350), container assembly 3 is, typically, lifted by means of inserting lift members (e.g., lift forks 119, 122) through the second open ends (158, 161) of the first and second elongated tubes (32, 44).

Figure 21:
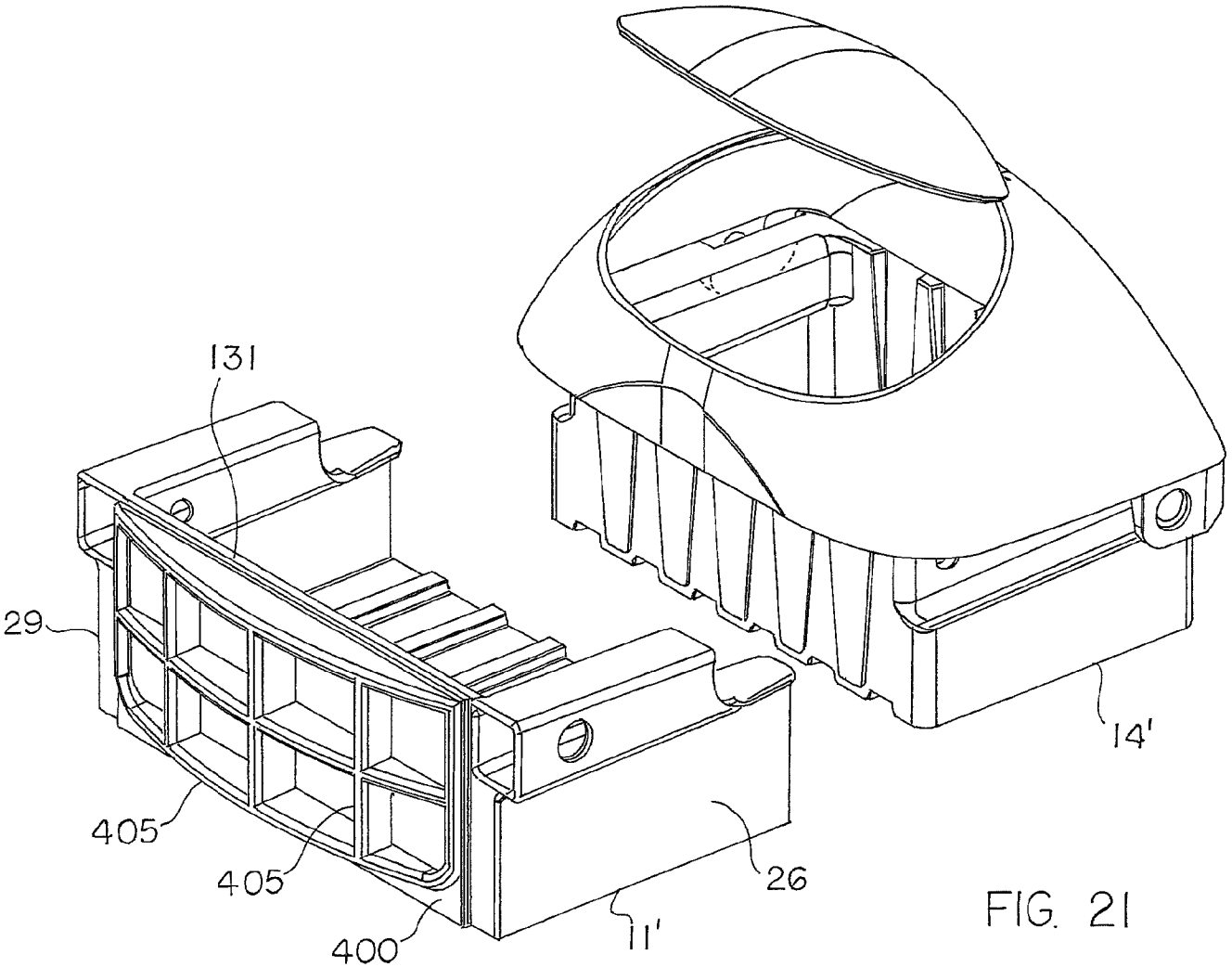
FIG. 21 is a representative perspective exploded view of a container assembly according to the present invention.
Figure 22:
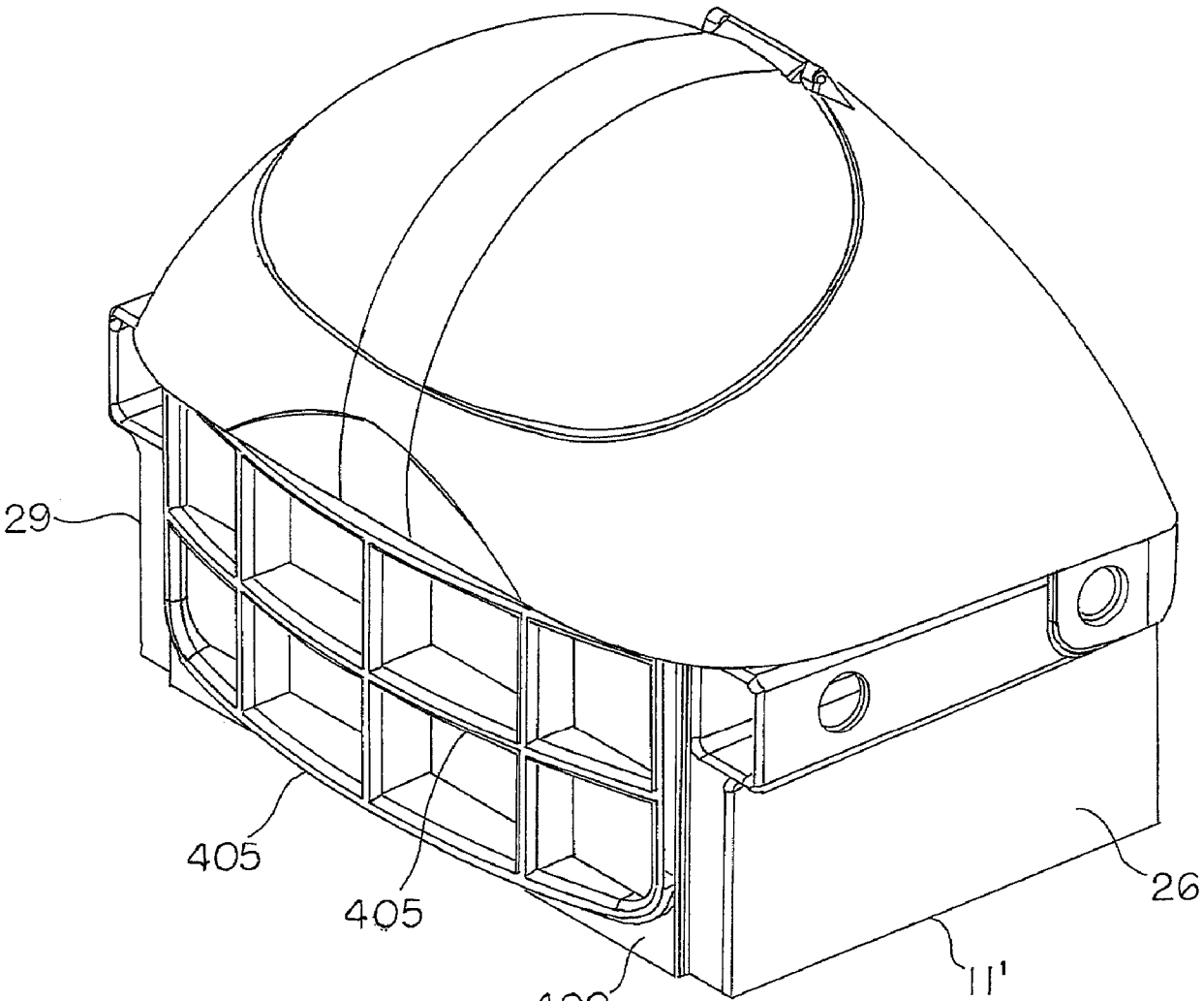
FIG. 22 is a representative perspective view of a container assembly according to the present invention.

In an embodiment, at least a portion of the container, and in particular, the support structure has a portion, in particular, an exterior surface 400 of the rear support wall 131 has a sports themed shape, such as for example the shape of a sports helmet face mask, visor or other shape and which is optionally complimentary to an upper container portion 14' having a hockey helmet shape or an American football helmet shape or a protective racing helmet shape. With reference to FIGS. 21, and 22, container assembly 3 includes a support structure 11', and a container 14'. Support structure 11' is as described previously herein except that the rear support wall 131 has a sports themed shape. Specifically, an outer surface 400 on rear support wall 131 has a series of flanges 405 which taken together resemble the face mask of a sports helmet (i.e. the flanges form a "look-alike" element resembling a face mask). The flanges can be continuous or discontinuous with one another so long as they define a look-alike for a sports helmet element such as for example a face mask. The flanges can have any suitable shape or design and can be made of any suitable material such as for example plastic, metal or composite materials and they may be optionally integrally molded with, mechanically affixed to or adhesively affixed to the outer surface 400 of the rear support wall 131. The flanges may also be upstanding elements on a separate wall piece or backing, the entirety of which is affixed to the outer surface of rear support wall 131.

In addition to a sports themed shape for the rear support wall 131, it is also contemplated that the exterior surfaces of side walls 26 and 29 of the support structure 11' may optionally have look-alike elements resembling those of a sports helmet or a sports ball. For example, the outer surfaces of side wall 26 and 29 may have flanged elements which represent the face mask of a sports helmet. Optionally, sports themed look-alike elements present on the outer surface 400 on rear support wall 131 may be continuous with sports themed look-alike elements present on the outer surfaces of side walls 26 and 29. For example, flanges 405 on the rear support wall may be continuous with additional flanges present on the outer surface of side walls 26 and 29, to resemble a wrap around face mask.

The support structure and container of the container assembly, and the various components thereof (e.g., elongated tubes, sidewalls, lids, etc.) may each independently be fabricated from any suitable material, and, in particular, any suitable rigid (e.g., self-supporting) material. Materials from which the support structure and container of the container assembly, and the various components thereof, may each be independently fabricated, include, but are not limited to: metals (e.g., iron, aluminum, steel, stainless steel, copper and combinations thereof); wood; ceramics; plastic materials, including thermoset plastic materials and/or thermoplastic materials; and combinations thereof.

In an embodiment of the present invention, the support structure is a substantially continuous unitary support structure, the container is a substantially continuous unitary container, and the support structure and the container are each independently fabricated from a plastic material selected independently from thermoset plastic materials, thermoplastic materials, and combinations thereof. As used herein and in the claims, the term "substantially unitary support structure" and similar terms, such as "substantially continuous unitary support structure," means the support structure and all components thereof (e.g., support base, first and second support sidewalls, first and second elongated tubes, and optional rear support wall) are continuous with each other. As used herein and in the claims, the term "substantially unitary container" and similar terms, such as, "substantially continuous unitary container", means the container and all components thereof (e.g., container base, first and second container sidewalls, and front and rear container walls) are continuous with each other.

As used herein and in the claims the term "thermoset plastic material" and similar terms, such as, "thermosetting or thermosetable plastic materials" means plastic materials having, or that form, a three dimensional crosslinked network resulting from the formation of covalent bonds between chemically reactive groups, e.g., active hydrogen groups and free isocyanate groups, or between unsaturated groups. Thermoset plastic materials from which the support structure, container and various components thereof may each be independently fabricated include those known to the skilled artisan, e.g., crosslinked polyurethanes, crosslinked polyepoxides, crosslinked polyesters (such as, sheet molding compound compositions) and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as, toluene diisocyanate, and/or dimers and trimers of a diisocyanate such as toluene diisocyanate). The filled mold may optionally be heated to ensure and/or hasten complete reaction of the injected components.

As used herein and in the claims, the term "thermoplastic material" and similar terms, means a plastic material that has a softening or melting point, and is substantially free of a three dimensional crosslinked network resulting from the formation of covalent bonds between chemically reactive groups (e.g., active hydrogen groups and free isocyanate groups) of separate polymer chains and/or crosslinking agents. Examples of thermoplastic materials from which the support structure, container and various components thereof may each be independently fabricated include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth)

acrylates, thermoplastic acrylonitrile-butadiene-styrene, thermoplastic styrene-acrylonitrile, thermoplastic acrylonitrile-styrene-acrylate and combinations thereof (e.g., blends and/or alloys of at least two thereof).

In an embodiment of the present invention, the thermoplastic material from which the support structure, container and various components thereof may be fabricated is independently selected from thermoplastic polyolefins. As used herein and in the claims, the term "polyolefin" and similar terms, such as, "polyalkylene" and "thermoplastic polyolefin", means polyolefin homopolymers, polyolefin copolymers, homogeneous polyolefins and/or heterogeneous polyolefins. For purposes of illustration, examples of a polyolefin copolymers include those prepared from ethylene and one or more $C_3$-$C_{12}$ alpha-olefins, such as, 1-butene, 1-hexene and/or 1-octene.

The polyolefins, from which the support structure, container and various components thereof may each be independently fabricated, include heterogeneous polyolefins, homogeneous polyolefins, or combinations thereof. The term "heterogeneous polyolefin" and similar terms means polyolefins having a relatively wide variation in: (i) molecular weight amongst individual polymer chains (i.e., a polydispersity index of greater than or equal to 3); and (ii) monomer residue distribution (in the case of copolymers) amongst individual polymer chains. The term "polydispersity index" (PDI) means the ratio of $M_w/M_n$, where $M_w$ means weight average molecular weight, and $M_n$ means number average molecular weight, each being determined by means of gel permeation chromatography (GPC) using appropriate standards, such as, polyethylene standards. Heterogeneous polyolefins are typically prepared by means of Ziegler-Natta type catalysis in heterogeneous phase.

The term "homogeneous polyolefin" and similar terms means polyolefins having a relatively narrow variation in: (i) molecular weight amongst individual polymer chains (i.e., a polydispersity index of less than 3); and (ii) monomer residue distribution (in the case of copolymers) amongst individual polymer chains. As such, and, in contrast to, heterogeneous polyolefins, homogeneous polyolefins have similar chain lengths amongst individual polymer chains, a relatively even distribution of monomer residues along polymer chain backbones, and a relatively similar distribution of monomer residues amongst individual polymer chain backbones. Homogeneous polyolefins are typically prepared by means of single-site, metallocene or constrained-geometry catalysis. The monomer residue distribution of homogeneous polyolefin copolymers may be characterized by composition distribution breadth index (CDBI) values, which are defined as the weight percent of polymer molecules having a comonomer residue content within 50 percent of the median total molar comonomer content. As such, a polyolefin homopolymer has a CDBI value of 100 percent. For example, homogenous polyethylene/alpha-olefin copolymers typically have CDBI values of greater than 60 percent or greater than 70 percent. Composition distribution breadth index values may be determined by art recognized methods, for example, temperature rising elution fractionation (TREF), as described by Wild et al, Journal of Polymer Science, Poly. Phys. Ed., Vol. 20, p. 441 (1982), or in U.S. Pat. No. 4,798,081, or in U.S. Pat. No. 5,089,321. An example of homogeneous ethylene/alpha-olefin copolymers are SURPASS polyethylenes, commercially available from NOVA Chemicals Inc.

The plastic materials from which the support structure, container and various components thereof may be fabricated, may, in each case, independently and optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the component (i.e., the sum of the weight of the plastic material and the reinforcing material). The reinforcing fibers, and the glass fibers in particular, may have sizings on their surfaces to improve miscibility and/or adhesion to the plastic materials into which they are incorporated, as is known to the skilled artisan.

In addition or alternatively to reinforcing material(s), the plastic materials from which the support structure, container and various components thereof may be fabricated, may in each case independently and optionally further include one or more additives. Additives that may be present in the plastic materials include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material of each plastic component in functionally sufficient amounts, e.g., in amounts independently from 0.1 percent by weight to 10 percent by weight, based on the total weight of the particular plastic component.

The plastic components of the container assembly of the present invention may be prepared by art-recognized methods, including, but not limited to, injection molding, reaction injection molding, compression molding, sheet thermoforming, rotational molding and blow molding. Typically, the plastic components of the container assembly are fabricated by injection molding in the case of thermoplastic materials, and reaction injection molding in the case of thermoset plastic materials.

The container assembly of the present invention, and the various components thereof, may have any suitable dimensions. For purposes of illustration and with reference to FIGS. 10 and 11, support structure 11 may have a width 356, from the exterior surfaces of the first and second support sidewalls (26, 29), of from 0.5 to 5 meters, typically, from 1 to 4 meters, and, more typically, from 1.5 to 3 meters. In a particular embodiment, support structure 11 has a width 356 of 1.88 meters. Support structure 11 may have a length or depth 359, from rear portion 56 to forward portion 59, of from 0.25 to 4 meters, typically, from 0.5 to 3 meters, and, more typically, from 0.75 to 2 meters. In a particular embodiment, support structure 11 has a length or depth 359 of 1.17 meters. Support structure 11 may have a maximum height 362 (from lower surface 23 of support base 17 to the upper extent of the elongated tubes) of from 0.5 to 4 meters, typically, from 0.5 to 3 meters, and, more typically, from 0.5 to 2 meters. In a particular embodiment, support structure 11 has a maximum height 362 of 0.79 meters. Each support sidewall (26, 29) of the support structure may independently have a height 365 (from lower surface 23 of support base 17 to the upper surface of the forward shelf, e.g., 296, of the elongated tube) of from 0.2 to 1.75 meters, typically, from 0.25 to 1.5 meters, and, more typically, from 0.3 to 1 meters. In a particular embodiment, each support sidewall of the support structure has a height 365 of 0.55 meters.

When including a forward shelf (e.g., 296, 302), each elongated tube (e.g., 32, 44) of the support structure may have a length 365 (from the second open end 185, 161; to the first open end 38, 50 thereof) of from 39 to 160 cm, typically, from 50 to 125 cm, and, more typically, from 75 to 100 cm. In an embodiment, each elongated tube has a length 365 of 78.74 cm. The forward shelf (e.g., 296, 302) of each elongated tube (e.g., 32, 44) may have a length 368 of from 15 to 75 cm, typically, from 20 to 60 cm, and, more typically, from 25 to 50 cm. In a particular embodiment, each forward shelf (e.g., 296, 302) of each elongated tube (e.g., 32, 44) has a length 368 of 35.56 cm.

When free of a forward shelf, each elongated tube (e.g., 32, 44) may have a length that is substantially equivalent to the sum of the tube and forward shelf lengths (365, 368), or substantially equivalent to the length or depth 359 of the support structure. When free of a forward shelf (e.g., 296, 302), the first and second elongated tubes each, typically, have a length 371 of from 25 to 400 cm, typically, from 50 to 300 cm, and, more typically, from 75 to 200 cm. In a particular embodiment, each forward shelf free elongated tube has a length 371 of 117 cm.

Each elongated tube (e.g., 32, 44) may independently have a width 374 (from outboard tube wall portion 230, 239; to inboard wall portion 227, 236 thereof) of from 10 to 100 cm, typically, from 12 to 75 cm, and, more typically, from 15 to 50 cm. In a particular embodiment, each elongated tube has a width 374 of 22.86 cm.

The container (e.g., 14) of the container assembly may have any suitable dimensions. For purposes of further illustration and with reference to FIGS. 3 and 4, container 14 may have a maximum width 377 (from the furthest outward extent of first container sidewall 77 to the furthest outward extent of second container sidewall 80) of from 0.75 to 5 meters, typically, from 1 to 4 meters, and, more typically, from 1.25 to 3 meters. In a particular embodiment, container 14 has a maximum width 377 of 2.08 meters. Container 14 may have a maximum length or depth 380 (from rear container wall 86 to front container wall 83) of from of from 0.4 to 3.5 meters, typically, from 0.5 to 3 meters, and, more typically, from 0.75 to 2.75 meters. In a particular embodiment, container 14 has a maximum length or depth 380 of 1.15 meters. Container 14 may have a maximum height 383 (from lower surface 95 of container base 74 to the upper extent of upper container portion 125, but not including lid 308) of from 0.5 to 3 meters, typically, from 0.75 to 2.75 meters, and, more typically, from 1 to 2.25 meters. In a particular embodiment, container 14 has a maximum height 383 of 1.52 meters.

The container interior of the container of the container assembly may have any suitable volume. For example, container interior 92 of container 14 may have a volume of from 1000 liters to 6100 liters, typically, from 1250 liters to 3500 liters, and, more typically, from 1275 liters to 3000 liters. In an embodiment, container interior 92 of container 14 has a volume of 2300 liters.

The container assembly of the present invention, and in particular the container thereof, may be used to contain, hold or store any suitable material or materials, examples of which include, but are not limited to: liquids (e.g., water); grains (e.g., wheat, corn or barley); and refuse (e.g., recyclable refuse, compostable refuse, and landfill refuse). In a particular embodiment, the container assembly is a refuse container assembly, and is used to contain refuse, such as: recyclable refuse (e.g., metals, glass, plastics, paper and/or wood); compostable refuse (e.g., farm, home or restaurant food or feed waste); and landfill refuse, which is typically refuse that is neither recyclable nor compostable.

The present invention has been described with reference to specific details of particular embodiments thereof. It is not intended that such details be regarded as limitations upon the scope of the invention except insofar as and to the extent that they are included in the accompanying claims.

What is claimed is:

1. A container assembly comprising:

(a) a support structure comprising, (i) a support base having an upper surface, (ii) a first support sidewall extending upwardly from said support base, said first support sidewall comprising a first elongated tube having an elongated hollow interior and a first open end that is in communication with said elongated hollow interior of said first elongated tube, and (iii) a second support sidewall extending upwardly from said support base, said second support sidewall comprising a second elongated tube having an elongated hollow interior and a first open end that is in communication with said elongated hollow interior of said second elongated tube, said first support sidewall and said second support sidewall being laterally spaced apart and opposed from each other, said support base, said first support sidewall and said second support sidewall together defining a support structure interior and an open forward portion of said support structure; and (b) a container having a container base, a first container sidewall, a second container sidewall, a front container wall and a rear container wall, each extending upwardly from said container base and together defining an open container top and a container interior, said container base having a lower surface, said first container sidewall and said second container sidewall being laterally spaced apart and opposed from each other and each having an exterior surface, said exterior surface of said first container sidewall having a first elongated channel, said first elongated channel having a first open end along said rear container wall, said first open end of said first elongated channel and said first elongated channel each being dimensioned to non-permanently receive at least a portion of said first elongated tube, said exterior surface of said second container sidewall having a second elongated channel, said second elongated channel having a first open end along said rear container wall, said first open end of said second elongated channel and said second elongated channel each being dimensioned to non-permanently receive at least a portion of said second elongated tube, wherein at least a portion of said container non-permanently resides within said support structure interior, at least a portion of said first elongated tube non-permanently resides within said first elongated channel, and at least a portion of said second elongated tube non-permanently resides within said second elongated channel, further wherein said first open end and said elongated hollow interior of said first elongated tube are each dimensioned to receive a first lift member therein, and said first open end and said elongated hollow interior of said second elongated tube are each dimensioned to receive a second lift member therein, thereby allowing said container assembly to be lifted.

2. The container assembly of claim 1 wherein said container comprises an upper container portion and a lower container portion, said lower container portion resides substantially below said upper container portion, and comprises said first elongated channel and said second elongated channel, said upper container portion resides above, said first elongated channel, said second elongated channel, and said lower container portion, and said lower container portion resides non-permanently within said support structure interior, and said upper container portion resides above said support structure interior.

3. The container assembly of claim 1 wherein said support structure further comprises a rear support wall.

4. The container assembly of claim 3 wherein said rear support wall has an interior surface, said rear container wall has an exterior surface, and at least a portion of said interior surface of said rear support wall and at least a portion of said exterior surface of said rear container wall abut each other.

5. The container assembly of claim 1 wherein at least a portion of said upper surface of said support base and at least a portion of said lower surface of said container base have a spatial relationship selected from the group consisting of opposingly separated, abutting and combinations thereof.

6. The container assembly of claim 1 wherein said upper surface of said support base comprises a plurality of elongated tongues extending upwardly from said upper surface of said support base, said support base having a forward portion and a rear portion, said elongated tongues extending from said forward portion to said rear portion of said support base, said lower surface of said container base comprising a plurality of elongated grooves extending from said rear container wall to said front container wall, said elongated grooves being dimensioned to non-permanently receive therein said elongated tongues, and said elongated tongues of said upper surface of said support base non-permanently residing within said elongated grooves of said lower surface of said container base.

7. The container assembly of claim 1 wherein said first elongated tube has a second open end that is in communication with said elongated hollow interior of said first elongated tube, and said first open end and said second open end of said first elongated tube are each located at opposite ends of said first elongated tube, and said second elongated tube has a second open end that is in communication with said elongated hollow interior of said second elongated tube, and said first open end and said second open end of said second elongated tube are each located at opposite ends of said second elongated tube.

8. The container assembly of claim 1 wherein said first elongated channel and said second elongated channel are each independently defined in part by an upper channel surface and a lower channel surface, said upper channel surface and said lower channel surface of each of said first elongated channel and said second elongated channel in each case tapering towards each other from said rear container wall towards said front container wall, said first elongated tube and said second elongated tube each having a rear tube portion, a front tube portion, an exterior upper tube surface and an exterior lower tube surface, said exterior upper tube surface and said exterior lower tube surface of each of said first elongated tube and said second elongated tube in each case tapering towards each other from said rear tube portion towards said front tube portion, said front tube portion of said first elongated tube being received through said first open end of said first elongated channel, said exterior upper tube surface of said first elongated tube abutting said upper channel surface of said first elongated channel, and said exterior lower tube surface of said first elongated tube abutting said lower channel surface of said first elongated channel, and said front tube portion of said second elongated tube being received through said first open end of said second elongated channel, said exterior upper tube surface of said second elongated tube abutting said upper channel surface of said second elongated channel, and said exterior lower tube surface of said second elongated tube abutting said lower channel surface of said second elongated channel.

9. The container assembly of claim 8 wherein said first elongated channel and said second elongated channel are each independently further defined in each case by an inner channel surface, for said first elongated channel, said upper channel surface and said lower channel surface each independently have a lateral outwardly extending distance relative to said inner channel surface, and said lateral outwardly extending distance of said upper channel surface being greater than said lateral outwardly extending distance of said lower channel surface, and for said second elongated channel, said upper channel surface and said lower channel surface each independently have a lateral outwardly extending distance relative to said inner channel surface, and said lateral outwardly extending distance of said upper channel surface being greater than said lateral outwardly extending distance of said lower channel surface.

10. The container assembly of claim 1 wherein said first elongated tube and said second elongated tube each have a tube wall having an inboard tube wall portion and an outboard tube wall portion, said inboard tube wall portion of said first elongated tube facing towards said support structure interior and said outboard tube wall portion of said first elongated tube facing away from said support structure interior, said inboard tube wall portion of said second elongated tube facing towards said support structure interior and said outboard tube wall portion of said second elongated tube facing away from said support structure interior, said inboard tube wall portion of said first elongated tube having an aperture, a portion of said first container sidewall defining said first elongated channel having an aperture that is aligned with said aperture of said inboard tube wall portion of said first elongated tube and together forming a pair of aligned first tube-first channel apertures, a first retaining pin residing within said pair of aligned first tube-first channel apertures, said inboard tube wall portion of said second elongated tube having an aperture, a portion of said second container sidewall defining said second elongated channel having an aperture that is aligned with said aperture of said inboard tube wall portion of said second elongated tube and together forming a pair of aligned second tube-second channel apertures, a second retaining pin residing within said pair of aligned second tube-second channel apertures, and said first retaining pin preventing longitudinal movement of said first elongated tube within said first elongated channel, and said second retaining pin preventing longitudinal movement of said second elongated tube within said second elongated channel.

11. The container assembly of claim 10 wherein said outboard tube wall portion of said first elongated tube comprises an aperture that is aligned with said aperture of said inboard tube wall portion of said first elongated tube, said aperture of said outboard tube wall portion of said first elongated tube being dimensioned to receive said first retaining pin therethrough, and said outboard tube wall portion of said second elongated tube comprises an aperture that is aligned with said aperture of said inboard tube wall portion of said second elongated tube, said aperture of said outboard tube wall portion of said second elongated tube being dimensioned to receive said second retaining pin therethrough.

12. The container assembly of claim 10 wherein said aperture of said first elongated channel is in communication with a first chamber of a first housing that is dimensioned and positioned to receive a portion of said first retaining pin therein, and said aperture of said second elongated channel is in communication with a second chamber of a second housing that is dimensioned and positioned to receive a portion of said second retaining pin therein.

13. The container assembly of claim 1 wherein said first elongated channel has a second open end along said front container wall, said second open end of said first elongated channel providing access to said first open end of said first elongated tube, and said second elongated channel has a second open end along said front container wall, said second open end of said second elongated channel providing access to said first open end of said second elongated tube.

14. The container assembly of claim 13 wherein said first open end of said first elongated tube is recessed within said first elongated channel relative to said second open end of said first elongated channel, and said first open end of said second elongated tube is recessed within said second elongated channel relative to said second open end of said second elongated channel.

15. The container assembly of claim 14 wherein said first elongated tube further comprises a first shelf extending forward relative to said first open end of said first elongated tube, at least a portion of said first shelf residing within said first elongated channel, and said second elongated tube further comprises a second shelf extending forward relative to said first open end of said second elongated tube, at least a portion of said second shelf residing within said second elongated channel.

16. The container assembly of claim 1 wherein said support structure is a unitary support structure, said container is a unitary container, and said support structure and said container each being independently fabricated from a plastic material selected independently from the group consisting of thermoset plastic materials, thermoplastic materials and combinations thereof.

17. The container assembly of claim 16 wherein said plastic material is a thermoplastic material selected independently from the group consisting of thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth)acrylates, thermoplastic acrylonitrile-butadiene-styrene, thermoplastic styrene-acrylonitrile, thermoplastic acrylonitrile-stryrene-acrylate and combinations thereof.

18. The container assembly of claim 1 wherein said container further comprises a reversibly closable lid that reversibly closes said open container top.

19. The container assembly of claim 1 wherein each lift member is selected independently from the group consisting of lift forks, lift straps and combinations thereof.

20. The container assembly of claim 1 wherein said container assembly is a refuse container assembly.

* * * * *